US005197762A

United States Patent [19]

Abramov

[11] Patent Number: 5,197,762

[45] Date of Patent: Mar. 30, 1993

[54] BOOKLET AND DOCUMENT FILING DEVICE

[76] Inventor: Igor Abramov, 501 Esplanade Ave., #226, Redondo Beach, Calif. 90277

[21] Appl. No.: 740,502

[22] Filed: Aug. 5, 1991

[51] Int. Cl.[5] ..... B42D 17/00

[52] U.S. Cl. ..... 281/43; 312/184; 211/46

[58] Field of Search ..... 281/45, 51; 283/117; 402/5, 8, 17; 312/184; 211/46, 113

[56] References Cited

U.S. PATENT DOCUMENTS

| | | | |
|---|---|---|---|
| 1,405,818 | 2/1922 | Dickerson . | |
| 2,197,235 | 4/1940 | Basher | 129/38 |
| 2,233,687 | 3/1941 | Vale | 129/38 |
| 2,323,123 | 6/1943 | Donato | 129/38 |
| 3,572,867 | 3/1971 | Cooper | 312/184 |
| 3,801,175 | 9/1972 | Giulie | 312/184 |
| 3,850,488 | 11/1974 | Elias | 312/184 |
| 3,865,445 | 2/1975 | Dean | 312/184 |
| 3,957,321 | 5/1976 | Rose | 402/17 |
| 4,009,784 | 3/1977 | Elias | 211/46 |
| 4,114,963 | 9/1978 | Menahem | 312/184 |
| 4,208,146 | 6/1980 | Schudy | 402/4 |
| 4,288,170 | 9/1981 | Barber | 402/17 |
| 4,395,058 | 7/1983 | Terrell | 281/46 |
| 4,403,816 | 9/1983 | Da Cruz Garcia | 312/184 |
| 4,420,086 | 12/1983 | Bardes | 211/46 |
| 4,449,270 | 5/1984 | Brabant | 16/87.4 |
| 4,487,520 | 12/1984 | Maier-Hunke | 402/65 |
| 4,624,480 | 11/1986 | Marthaler | 281/49 |
| 4,645,237 | 2/1987 | Squire | 281/47 |
| 4,681,232 | 7/1987 | Du Corday | 211/46 |
| 4,722,626 | 2/1988 | Abilgaard | 402/4 |
| 4,923,217 | 5/1990 | Pressler | 283/117 X |
| 4,950,096 | 8/1990 | Gilder | 402/4 |

*Primary Examiner*—Mark Rosenbaum
*Assistant Examiner*—Willmon Fridie, Jr.

[57] ABSTRACT

A filing device comprising suspension bar (60) with hooked end sections (64) is disclosed whereby the bar enables suspension of a booklet (70) from suspension rails (68) of a hanging-type filing system. A booklet essentially straddles the bar and can be attached to it permanently or semi-permanently. Single sheet documents can be also attached to the bar with an adhesive strip (62). Variations of the bar include ones with movable hook sections: pivotable (84), slidable (120), and hinged (130). Retainers are provided to releasably secure the hook sections in deployed and stowed positions. In two of its variations, the bar (160) can be permanently installed inside a booklet during binding operation, to become its integral part.

14 Claims, 24 Drawing Sheets

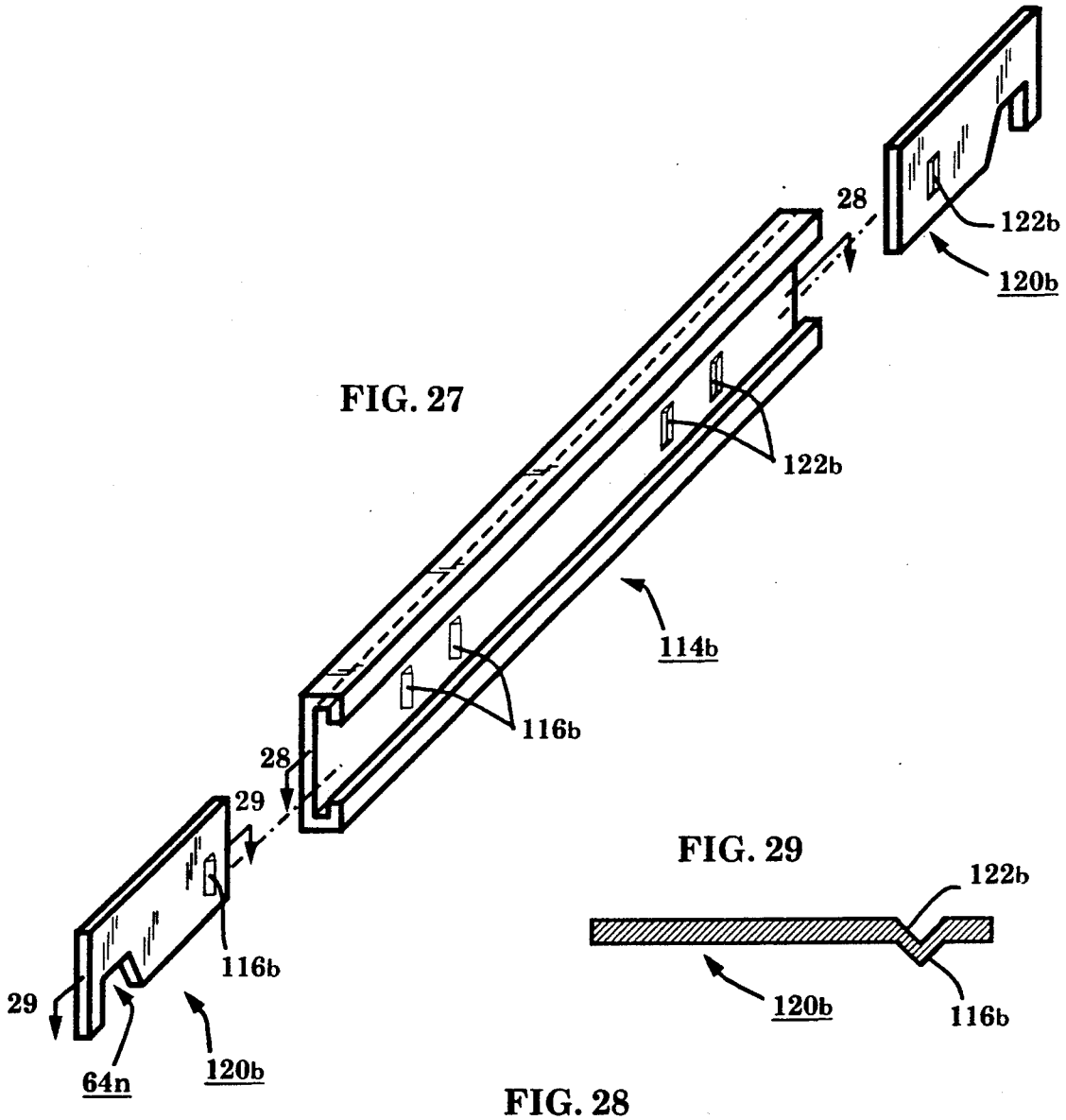
FIG. 27
FIG. 29
FIG. 28
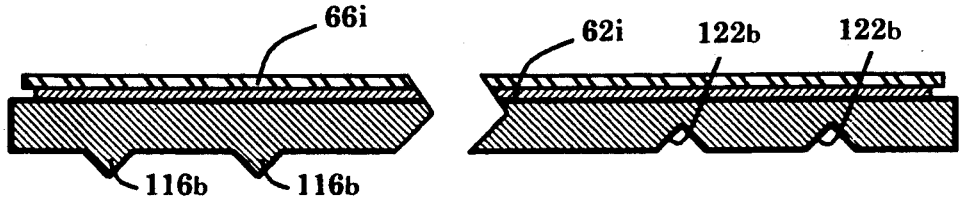

FIG. 65
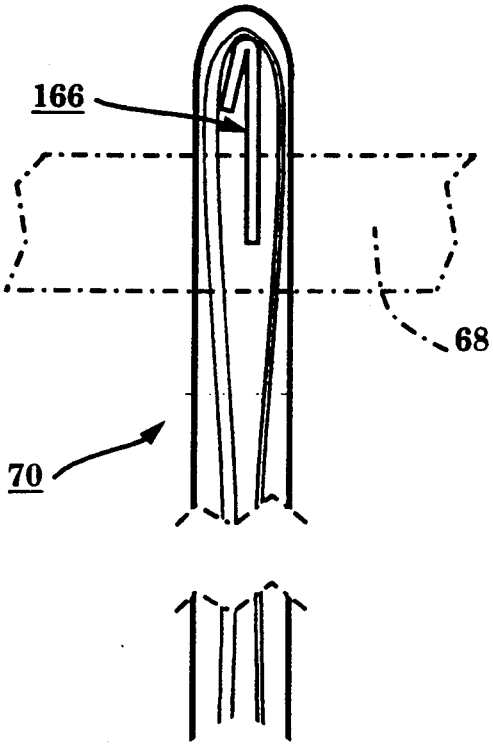
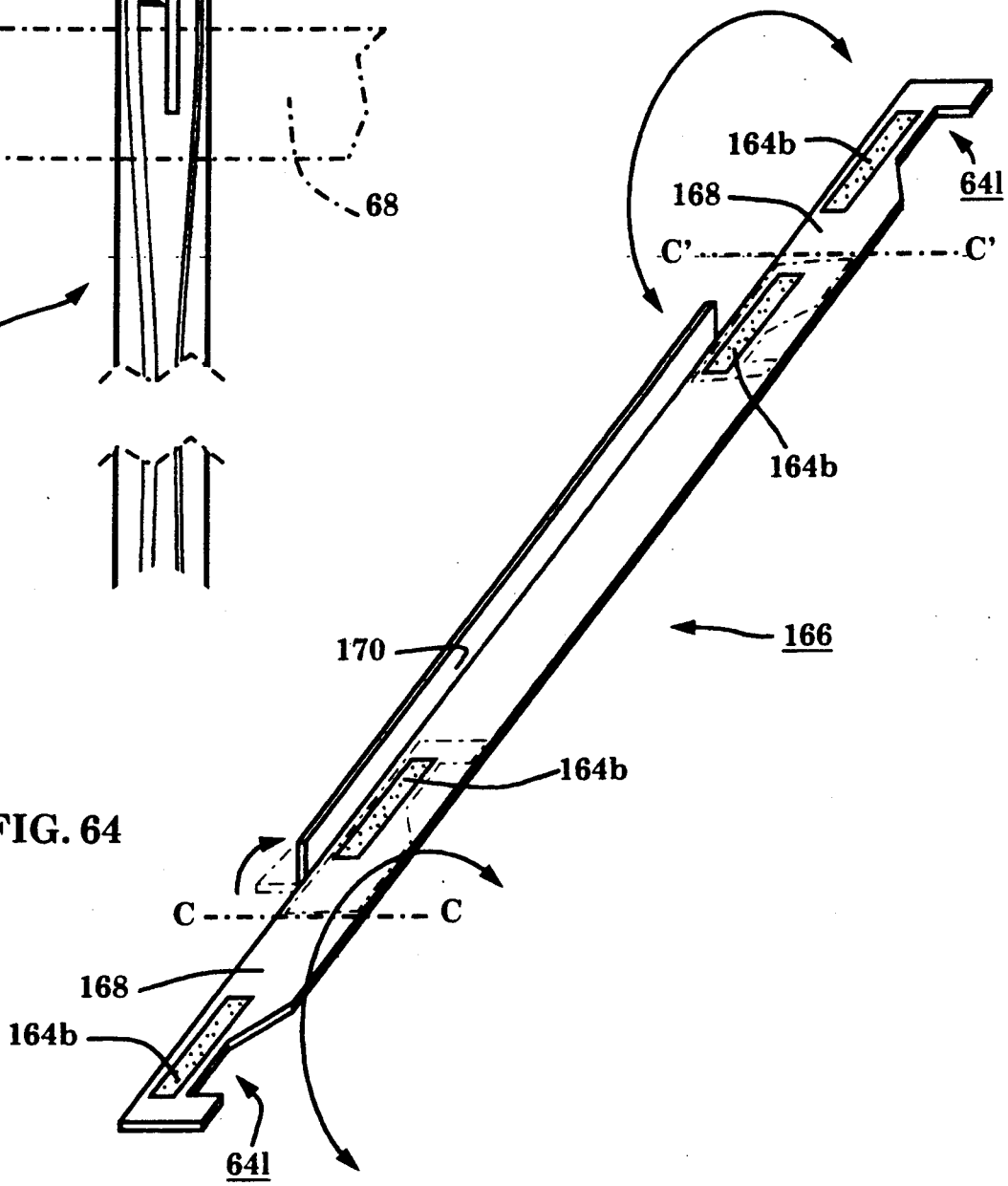
FIG. 64

BOOKLET AND DOCUMENT FILING DEVICE

This invention relates to filing of booklets, such as catalogs and periodicals, and documents, and specifically to device for suspension filing of such booklets and documents in hanging type filing systems.

BACKGROUND OF THE INVENTION

Thin booklets and other thin bound matter such as periodicals, catalogs and the like, along with single sheet documents are notoriously inconvenient to file due to their tendency to curl and bend when left to stand upright or when they are inserted in suspension folders.

In addition, because majority of thin booklets lack spines, it is impossible to directly imprint their titles or other identification marks which can be readily visible when the booklets are stacked or filed.

A common way to file thin booklets and documents is to puncture a row of holes along the document edge and to file the booklets directly inside a ring binder.

However, it is often desirable to store booklets in suspension type drawers for easy reference and proximity to other reference materials.

Several schemes have been proposed for filing the documents directly in a suspension-type drawer, whereby special hanging hardware interfaces with the holes made in a document for the purpose (U.S. Pat. Nos. 3,865,445, 4,420,086, 4,722,626). The necessity of having holes in the document limits utility of these devices, especially if the holes are not provided in the original document. Moreover, the presence of holes along the edge of a document frequently causes problems during copying, such as jamming of an automatic feed mechanism of a copier machine so equipped, or telltale hole images, often objectionable, appearing on a copy.

If holes in booklets are not feasible or desirable, various alternative schemes to file booklets have also been proposed. Majority of such schemes employ a bar, usually spring-loaded, which is inserted in the spine of the booklet, with booklet usually hanged in a special structure (U.S. Pat. Nos. 2,233,687, 2,323,123, 4,624,480, 4,645,237, 4,681,232). Unfortunately, most of these suspension devices require complicated suspension hardware to interface with filing systems. Furthermore, for relatively inexpensive booklets or documents, majority of which have short useful life, these suspension devices are of limited utility due to their cost.

SUMMARY OF THE PRESENT INVENTION

Accordingly, the purpose of the present invention is to provide a relatively simple and economical aid in filing of thin bound booklet-like matter, such as magazines, catalogs, and brochures in suspension type filing systems, including file drawers and cabinets. The device in its several embodiments can also be used to file single sheet documents.

It is a further purpose of this invention to provide a vehicle for attaching identifying insignia to thin booklets which cannot otherwise support such insignia because of the thinness of their spines, or lack of them.

It is yet another purpose of this invention to provide a booklet filing device which would be relatively compact and would produce minimum interference while inside the booklet, when the latter is in use and out of a filing drawer.

It is yet another purpose of this invention to provide suspension filing device for single sheet documents while optionally providing an implement for attaching identifying insignia to them.

Advantageously, the present booklet suspension device, hereinafter called the 'suspension bar', or simply a 'bar' for convenience, interfaces directly with existing and widely used filing systems such as suspension file drawers, cabinets, and racks.

The suspension bar of the present invention can be readily mass produced using inexpensive materials, and it can also be installed in a booklet by a user, and later discarded with the booklet upon the end the booklet's useful life.

The bar does not require tools for its installation, and, in the majority of its embodiments, can be removed from the booklet and reused, without damage to either itself or the booklet.

In addition, in several of its embodiments, the bar can be permanently incorporated in a booklet when the booklet is made, thus becoming its integral part. This way, the bar provides inexpensive built-in filing device for such publications as catalogs, and technical and trade periodicals which are often filed for reference.

BRIEF DESCRIPTION OF THE DRAWINGS

FIG. 27 is a perspective view of another variation of the bar with slidable sections which has projections on one side and detents on the other.

FIG. 28 is a cross section taken along the line 28—28 of FIG. 27.

FIG. 29 is a cross section taken along the line 29—29 of FIG. 27.

FIG. 64 is a perspective view of the permanently installed one-sided foldable suspension bar with a mounting tab.

FIG. 65 is an end view of the one-sided foldable bar with a mounting tab installed in the booklet.

DETAILED DESCRIPTION OF THE INVENTION

Figure 1:
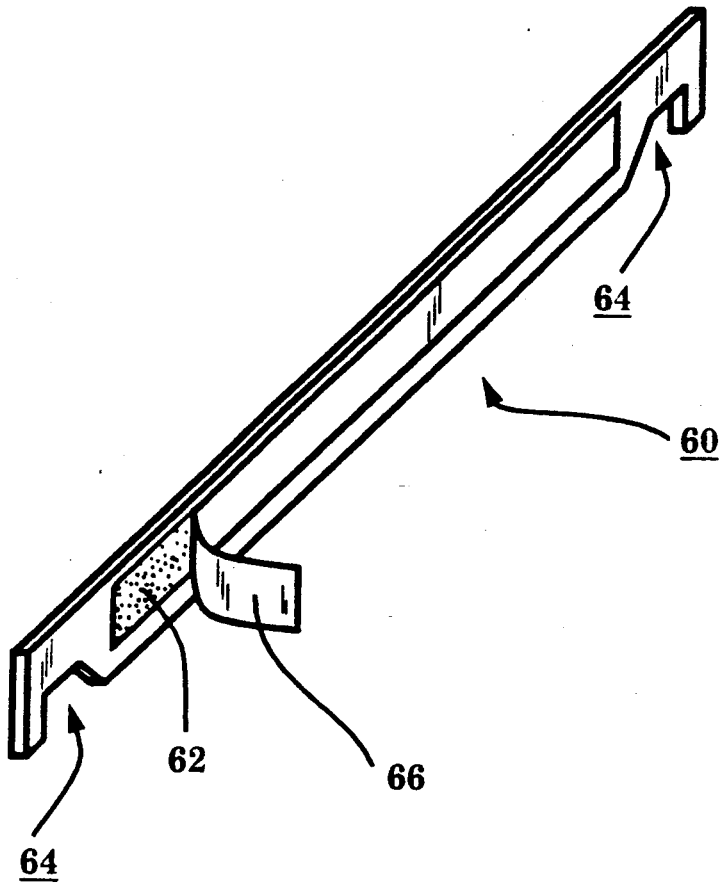
FIG. 1 shows the primary embodiment of the one-piece suspension bar with adhesive strip and release liner.

In its preferred embodiment the device comprises essentially a thin flat bar with two hook sections on each end as shown on FIG. 1. The bar 60 is constructed of a single piece of material, with integral hook openings 64. A pressure sensitive adhesive strip 62 is included on one or both sides of the bar for attachment inside the booklet and is protected by an overlapping removable protective liner 66, shown partially peeled back in the Figure, until the bar is ready to be installed in a booklet, at which time it is removed and discarded.

Figure 6:
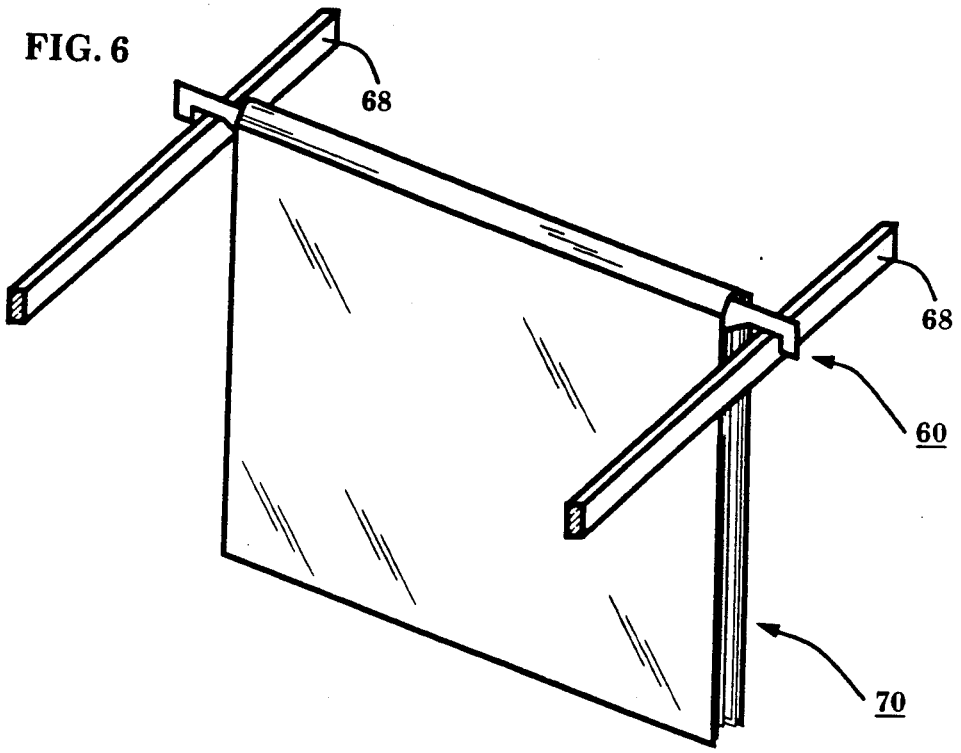
FIG. 6 is a perspective view of a booklet suspended from the parallel suspension rails of a filing system with the installed bar.
Figure 5:
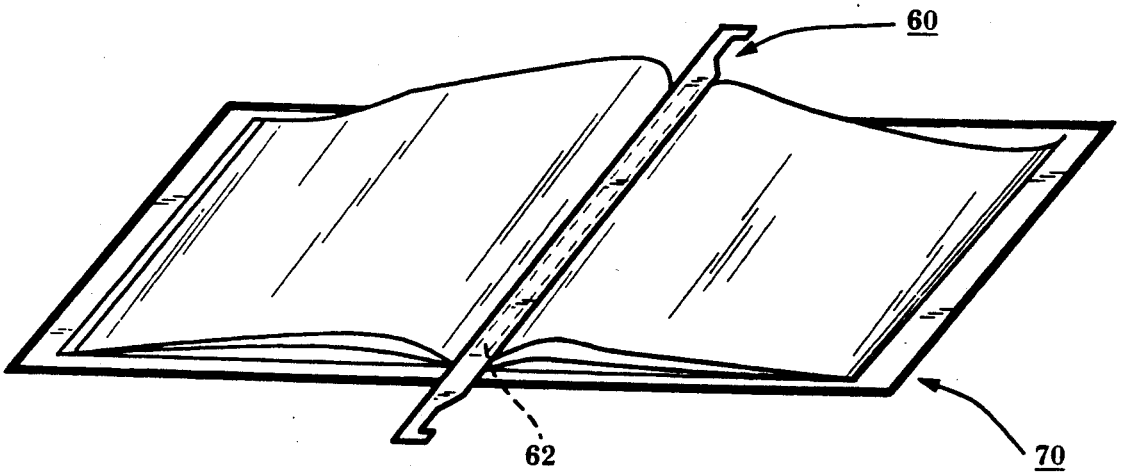
FIG. 5 shows mounting of the bar within a booklet with a help of an adhesive strip shown in phantom lines.
Figure 7:
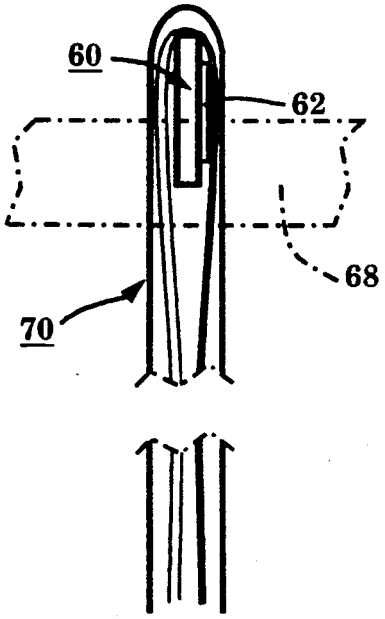
FIG. 7 is an end view of a booklet suspended by the bar from the suspension rails of a filing system.

As shown on FIGS. 5 through 7 the bar 60 is inserted inside of a booklet 70, preferably between the middle pages, and is optionally secured, permanently or semi-permanently with the adhesive strip. The booklet essentially straddles the bar and can be hanged from the two parallel suspension rails 68 of a suspension file drawer by the hook openings 64 of the bar, which advantageously are made to extend past the outline of the booklet, as shown on FIG. 6.

The purpose of the adhesive strip is to secure the bar in the booklet, so that the bar will remain in the booklet when the booklet is in use and is outside the filing drawer. For heavier objects, such as particularly thick catalogs, several bars can be adhesively attached to each other and used simultaneously. The use of the adhesive strip is otherwise optional, since the entire weight of the booklet is supported by the bar body.

The bar of this embodiment can be constructed of thin strip of metal, plastic, or cardboard. Because of the simplicity of its construction and modest structural demands, such a bar can be mass produced by stamping, molding, or die cutting.

The adhesive strip 62 used for bar attachment utilizes a permanent type of adhesive suitable for attaching dissimilar materials, such as those of the bar body and the booklet. Such an adhesive strip can be a double-sided adhesive tape, similar to the SCOTCH brand manufactured by the Minnesota Mining and Manufacturing Company, also known as 3M Company, St. Paul, Minn.

The removable protective liner 66 is made of waxed or silicone-coated paper, or a non-stick plastic such as TEFLON brand of PTFE, manufactured by E. I. du-Pont de Nemours & Co., Wilmington, Del. The liner can be made of other materials, provided they can be easily removed from the adhesive strip, without damage to it.

Conversely, the adhesive strip 62 can be made with a low-tack adhesive, similar to the POST-IT brand adhesive manufactured by the 3M Company. With this type of adhesive the bar can be removed from the booklet and reused, with no damage to either the bar or the booklet.

Figure 2:
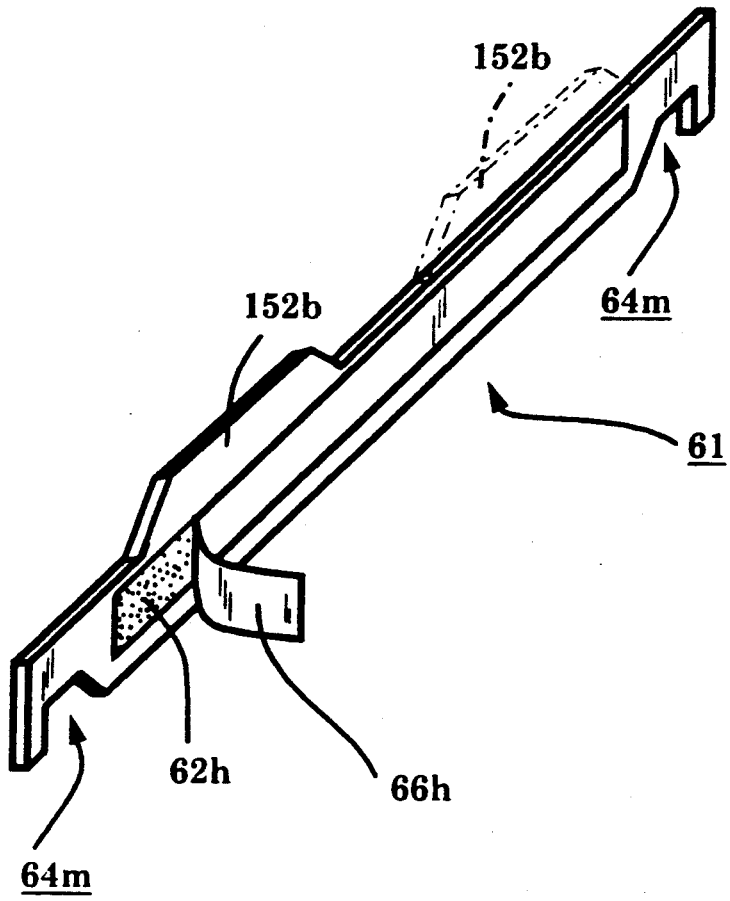
FIG. 2 shows another embodiment of the one-piece suspension bar containing one or several label supports.

A single sheet document also can be suspended by the edge by attaching it directly to the adhesive strip on the bar. A different embodiment of the bar, denoted 61 and shown on FIG. 2, is specifically suitable for filing single sheet documents, and incorporates one or several integral label supports 152*b*. The supports are formed along the upper edge of the bar in several locations similar to those of label tabs on suspension file folders. The bar of this embodiment has hook openings 64*m*, an adhesive strip 62*h*, and a removable protective liner 66*h*, which are essentially identical to the respective elements 62, 64, and 66 of the previous embodiment.

Figure 3:
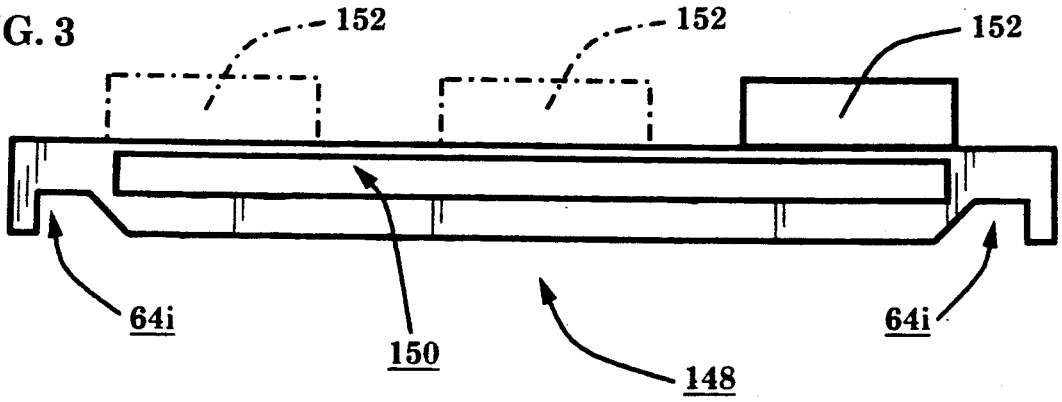
FIG. 3 shows the slotted version of the bar with optional label supports.

A variation the bar referred to as 148 and shown on FIG. 3 does not utilize an adhesive for securing the bar in the booklet, but instead has a longitudinal slot 150. An open booklet is then inserted into the slot until the spine of the booklet rests against the slot edge. The booklet is then closed and suspended from the bar. Advantageously, this type of bar may too utilize one or more integral label supports 152, to provide a vehicle for attaching identification labels to the bar, and, thus, to the booklet. As in the embodiment 61, the label support can be formed along the upper edge of the bar in several locations similar to those of label tabs on suspension file folders.

Figure 4:
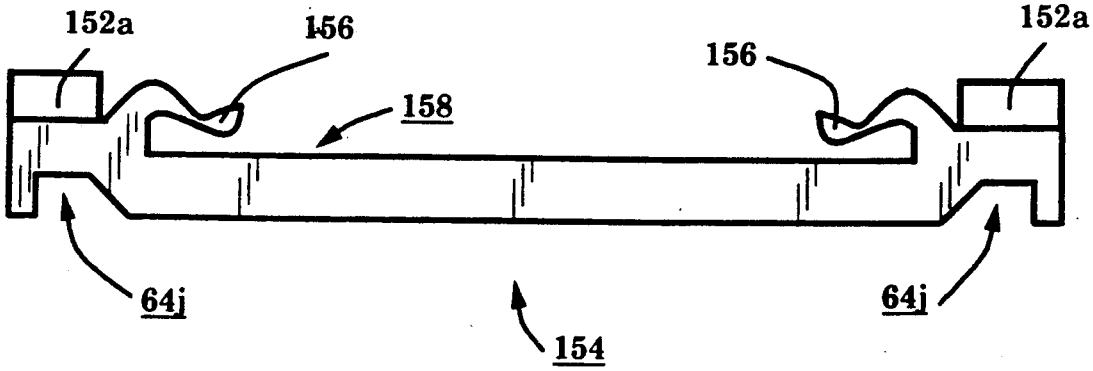
FIG. 4 shows a version of the bar with integral resilient retaining protrusions.

In another bar embodiment 154, shown on FIG. 4 the slot is replaced by two integral resilient projections 156 which secure a booklet within longitudinal depression 158 of the bar. Optional integral label supports 152*a* can be provided in this embodiment too.

The hook openings 64*j* and 64*i* of the embodiments 148 and 154 respectively, are essentially identical to the hook opening 64 of the embodiment 60.

While the suspension bar embodiments discussed above are attractive because of their simplicity, it is often also desirable to make the hook sections of the bar to be stowable within the outline of the booklet when the booklet is out of the filing system, and to make them deployable to hang the booklet for filing. To meet this requirement, in the suspension bar embodiments disclosed hereinafter the hook sections are made to be movable with respect to the main body of the bar.

In addition, while the embodiments that follow do not contain booklet identification implements themselves, labeling of booklets can still be accomplished by attaching a separate label holding tab to the spines of booklets. One type of such a tab is manufactured by Avery Corporation, Covina, Calif.

Also, in all the embodiments that follow, the adhesive layer and the protective liner are preferably included only on one side of the bar body opposite of the moving parts, or in between the movable hook sections.

FIGS. 8 through 21 show the hook sections made pivotable for deployment. The hook sections are retained in deployed or stowed positions by the action of projections and corresponding detents provided for this purpose on the hook sections themselves, as well as on the body of the bar.

Figure 9:
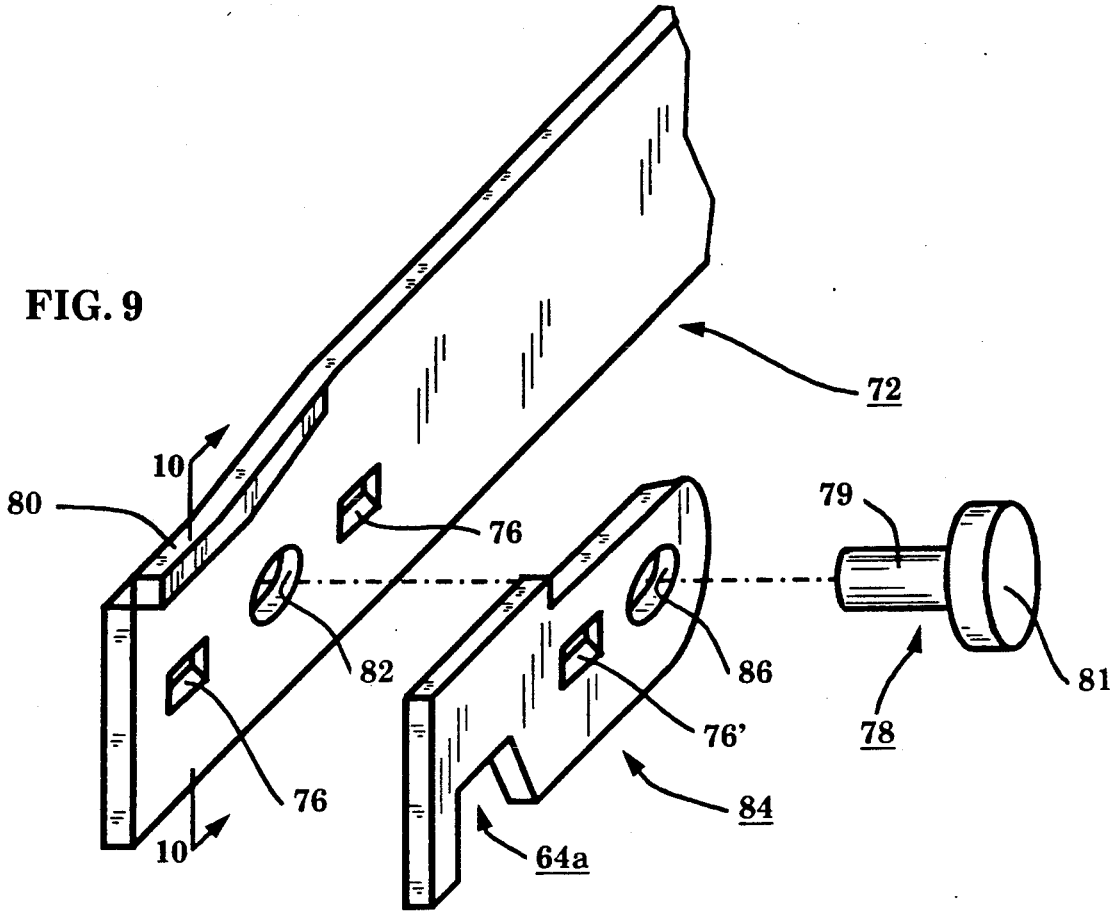
FIG. 9 is a fragmentary perspective view of the metal bar with pivotable hook sections.
Figure 10:
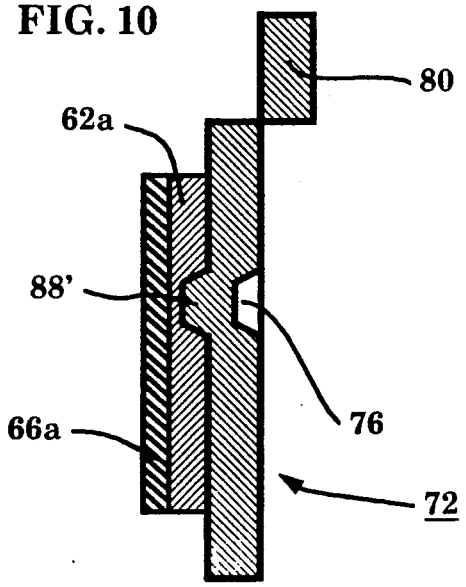
FIG. 10 is a cross-section taken along the line 10—10 of the FIG. 9.
Figure 11:
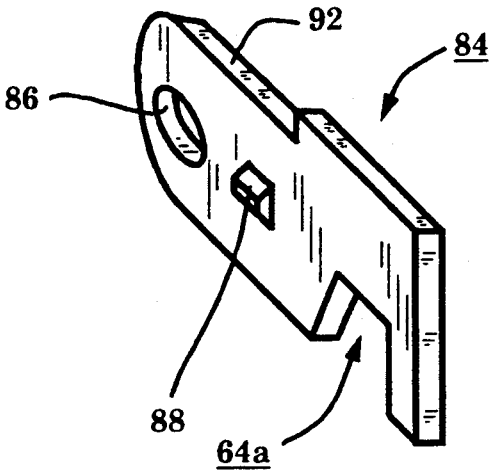
FIG. 11 is a perspective view of the pivotable hook section.

For convenience, on FIG. 9 and thereafter, in general, only one end of the bar is shown, with an understanding that the opposite end's construction is similar to the first one's. In cases where the ends of the bar differ from each other, they are both shown.

The pivotable hook sections 84 on FIG. 9 are preferably made of metal or plastic. They are secured to the body of the bar 72 by a pivot pin 78 comprising a pivot shaft 79 and a head 81. The pivot pin is inserted through the circular opening 86 of the hook section, and through the corresponding circular opening 82 of the bar body. Like the hook sections, the pivot pin also can be made of metal or plastic. In case the pin is metal, it is mechanically swaged on the opposite side of the bar assembly to rotatably secure the pivotable hook section to the bar body. In case of a plastic pivot pin, it can be stamped, or partially melted to form a locking tab on the opposite side of the assembly thus pivotally securing the hook section to the body of the bar.

The bar body 72 on FIG. 9 is made preferably of metal or plastic and contains offset stops 80 and detents 76 which are preferably stamped in it.

The hook sections are releasably retained in the deployed position by detents 76 which interface with projections 88 on the pivotable hook section 84. The rigidity of the hook sections in the deployed position is further enhanced by the offset stop 80 which interfaces with the shoulder 92 of the hook section. Depending on the manufacturing process employed for production of the bar, it can be advantageous to replace the stamped detents 76 with through holes for the same functional effect.

For stowing, the hook sections are rotated on pivot pins 78 into their stowed position where they are retained by the second set of detents 76 on the body of the bar.

By judiciously choosing the construction of the stamping or mold dies used for fabricating of the device, it is possible during the stamping or molding operation to form detents 76 and projections 88' simultaneously on the opposite sides of the bar body. This is illustrated on FIG. 10. It is also possible to make corresponding projections 88 and detents 76' on the pivotable hook section by the same method, as shown on FIGS. 9 and 11.

Figure 8:
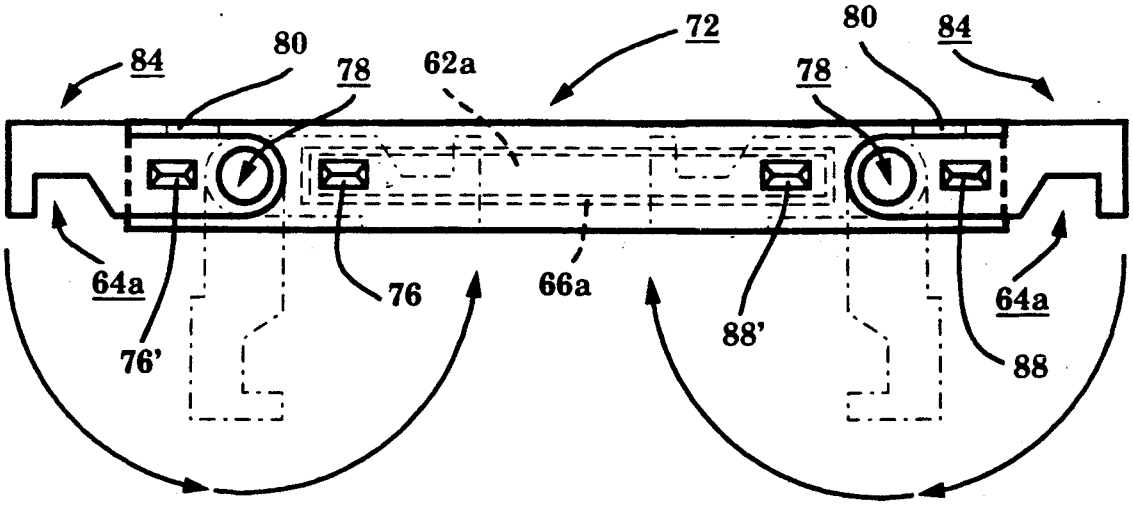
FIG. 8 is a view of a variation of a bar with hook sections made pivotable. Intermediate positions are shown in broken lines.

The advantages thus gained are illustrated on FIG. 8, whereby the body of the bar 72 has two detents 76 on its left end, and two projections 88' on the right one, both sets being fabricated in single stamping or molding operation. The hook section 84 now can be used for both left and right ends of the bar, since projections 88 on the hook section engage the detents 76 on the left end of the bar, and detents 76' engage projections 88' on the right end of the bar when the hook section is reversed.

Advantageously, the projections 88 and detents 76' on the hook section can also serve as finger grips to facilitate deployment and stowage of the pivotable hook sections. As in the previous embodiment, the hook openings 64a are made to engage the two parallel suspension rails 68 of a suspension file drawer.

The bar body 72 also contains an adhesive strip 62a and protective liner 66a which are essentially identical to the corresponding elements 62 and 66 of the primary embodiment.

Figure 12:
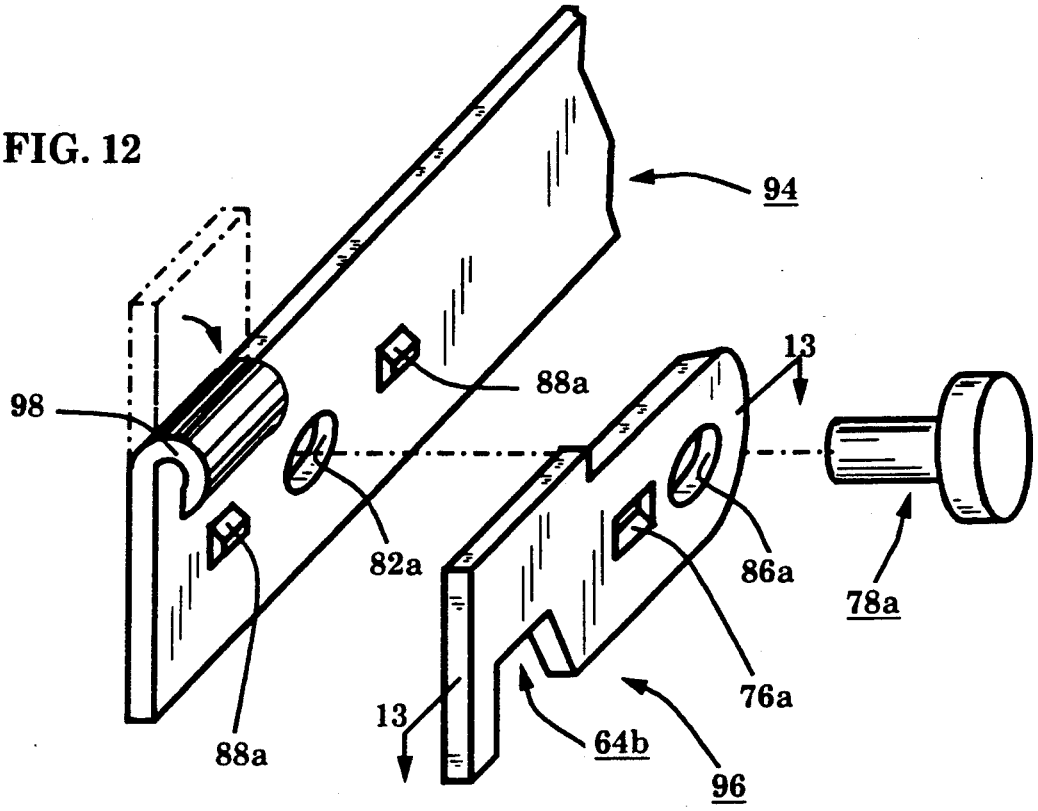
FIG. 12 is a fragmentary perspective view of a variation of the bar with pivotable hook sections and half-cylindrical stop.
Figure 13:
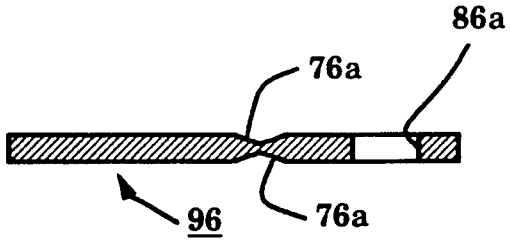
FIG. 13 is a cross section of a pivotable hook section taken along the line 13—13 of the FIG. 12.
Figure 14:
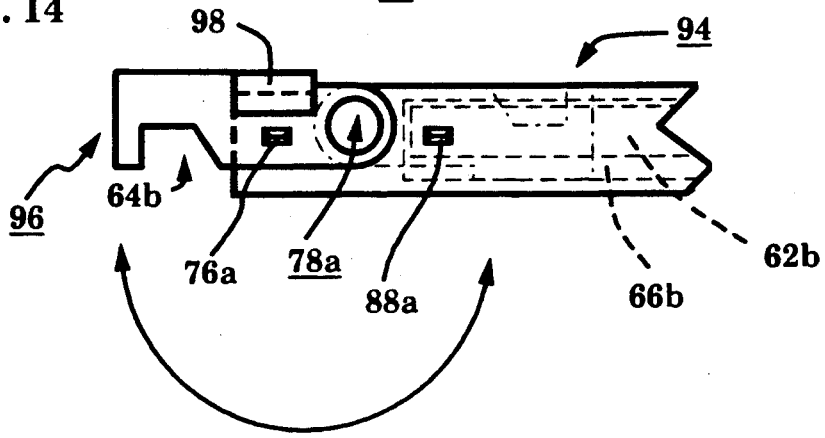
FIG. 14 is a fragmentary plan view of a variation of the bar with pivotable hook sections depicted on FIG. 12.
Figure 15:
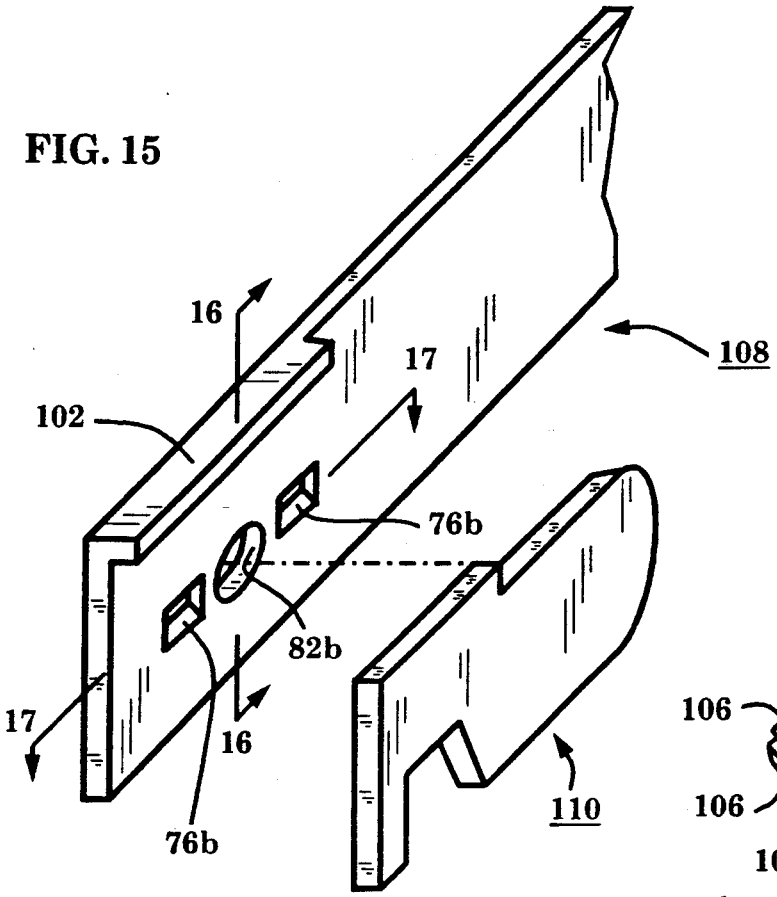
FIG. 15 is a fragmentary perspective view of another version of the bar with pivotable hook sections.
Figure 18:
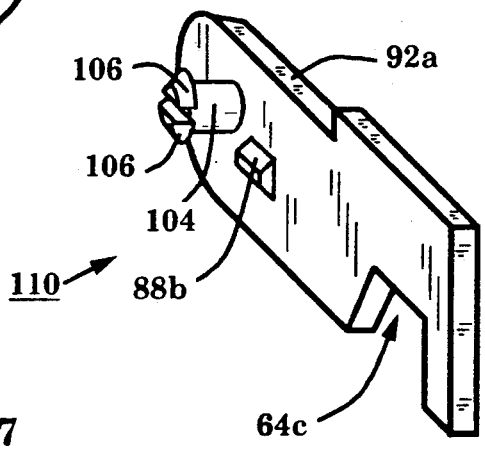
FIG. 18 is a perspective view of the pivotable hook section with integral pivot shaft.
Figure 16:
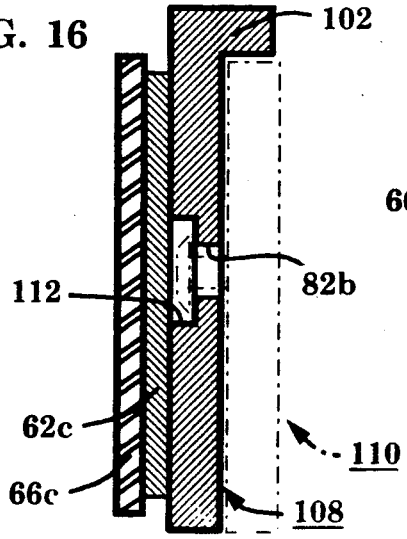
FIG. 16 is a cross section taken along the line 16—16 of the FIG. 15.
Figure 17:
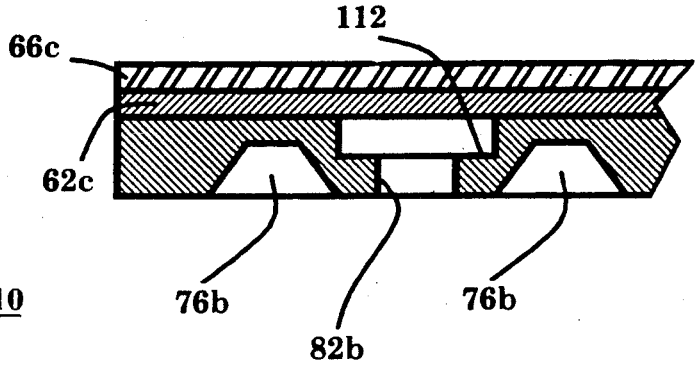
FIG. 17 is a cross section taken along the line 17—17 of the FIG. 15.

In another embodiment shown on FIGS. 12 through 14, the bar body 94 is essentially similar to the 72, except that the offset stop 80 is replaced by a bent stop 98, which is formed by partially folding a portion of the bar body first outwardly perpendicular to the plane of the bar body, and then downwardly on itself. By including horizontal and vertical components in its body, the stop not only secures the pivotable hook section 96 in the deployed position vertically, but also restricts its transverse movement, thus providing greater mechanical rigidity to the assembly while the hook sections are deployed.

The shape of the stop, although shown essentially half-cylindrical on FIG. 12 should not be considered as the only one suitable. The stop can take many different forms, provided it combines vertical and horizontal elements that sufficiently restrict the movement of a hooked section in deployed position.

With respect to the earlier embodiment, the detents on the bar body are replaced by projections 88a while the projections are replaced by detents 76a on the pivotable hook section 96. Having only detents on the hook section brings about an advantage in manufacturing and assembly, since the left and the right hook sections are identical and interchangeable, while at the same time having thinner cross-section.

The pivot pin 78a is essentially identical to the pivot pin 78 of the prior embodiment, the hook openings 64b, and the adhesive strip 62b and protective liner 66b are essentially identical to the hook opening 64a, the adhesive strip 62a and to the protective liner 66a of that embodiment.

The embodiments depicted on FIGS. 15 through 21 advantageously utilize inherent features of plastic forming technology to provide three dimensional structures at relatively low cost.

FIGS. 15 through 18 show another embodiment of the bar with pivotable hook sections. The bar body 108 is preferably made of plastic with integrally molded stop 102. The stop, although shown to be just long enough to interface with the shoulder 92a of the pivotable hook section 110, can be made to extend along the whole length of the bar for increased rigidity. Also, as in the previous embodiment, the stop can contain a vertical portion to restrict the transverse movement of the hook section.

The pivotable hook section 110 is preferably made of plastic and has an integrally molded pivot shaft 104 which is terminated by compliant locking tangs 106. The section also contains a projection 88b and hook opening 64c which are essentially similar to the corresponding elements 88 and 64a of a previous embodiment.

The pivotable hook section 110 after insertion into the bar body 108, is pivotally retained by locking tangs 106 of the pivot shaft 104 which engage the shoulder of the counterbore 112 in the circular opening 82b in the bar body 108. This attachment method is commonly known as a 'snap-fit' assembly.

The hook section 110 is releasably retained in deployed or stowed position by projections 88b on the hook section which engage corresponding detents 76b on the bar body.

As in the previous embodiments, the bar body 108 contains adhesive strip 62c and protective liner 66c which are essentially identical to the adhesive strip 62a and protective liner 66a of the previous embodiment.

Figure 19:
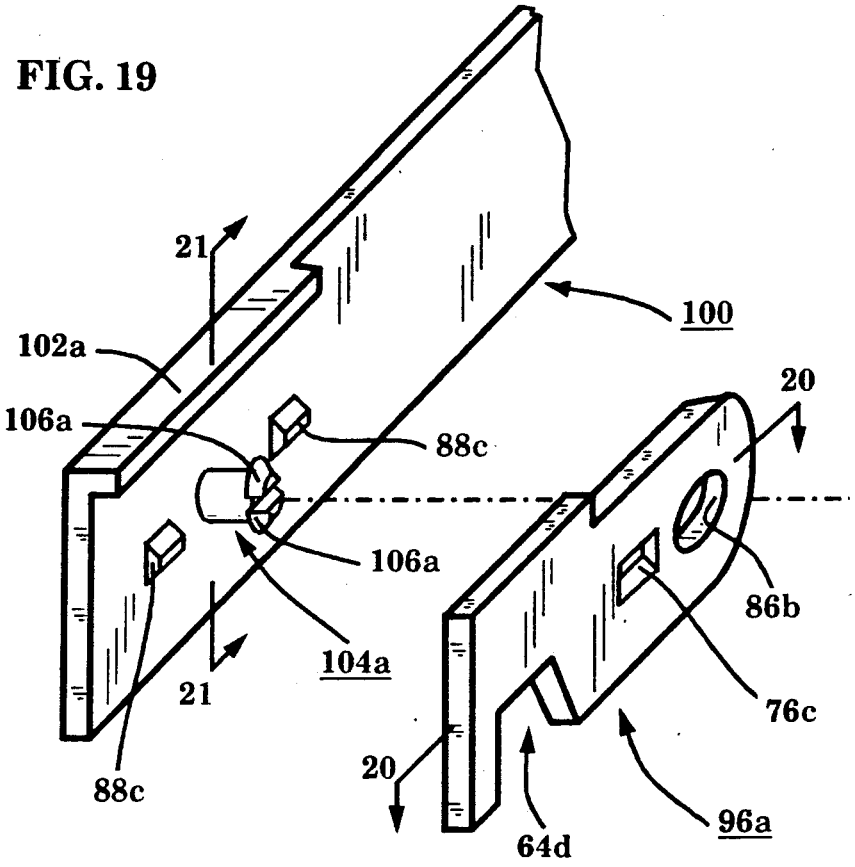
FIG. 19 is a fragmentary perspective view of another variation of the bar with pivotable hook sections which incorporates integral pivot shaft and stop.
Figure 20:
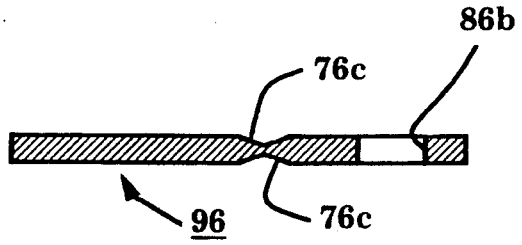
FIG. 20 is a cross section taken along the line 20—20 of the FIG. 19.
Figure 21:
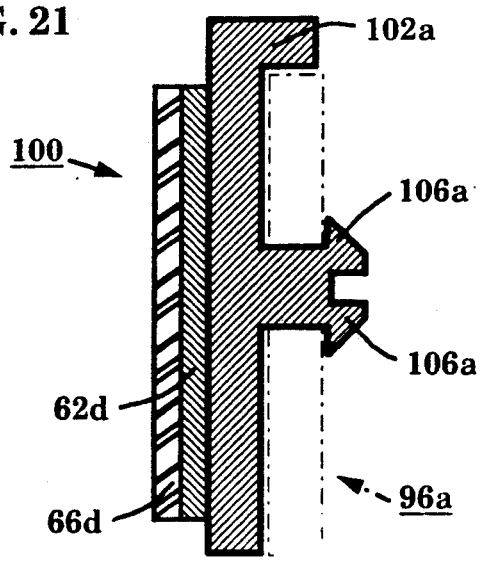
FIG. 21 is a cross section taken along the line 21—21 of the FIG. 19.

In another embodiment of the bar with pivotable hook sections, shown on FIGS. 19 through 21, the bar body 100 has an integrally molded pivot shaft 104a with compliant locking tangs 106a which are essentially similar to the corresponding elements 104 and 106 of the previous embodiment. The bar also contains an integrally molded stop 102a which is similar to the corresponding element 102 on the mentioned embodiment.

Each pivotable hook section 96a is made preferably of plastic or metal and contains a circular opening 86b, a hook opening 64d, and two detents 76c on each side.

The hook section 96a is pivotally secured to the bar body 100 by the locking action of the compliant tangs 106a, and is releasably retained in either deployed or stowed position by projections 88c on the bar body engaging detents 76c on the hook section.

Although not shown in the drawing, the opening 86b can also be countersunk to prevent tangs 106a of the pivot shaft from extending above the surface of the hook section and potentially damaging the pages of the booklet.

As in the case of an earlier embodiment 72, depending on the manufacturing process employed for production of the bar, it could be advantageous to replace the detents 76c with through holes for the same functional effect.

An essentially flat construction of the hook section 96a simplifies manufacturing of these elements and makes them usable on either end of the bar.

Furthermore, the detents and projections on the body of the bar and on the hook sections can be interchangeable without loss of function.

If the bar body and the hook sections are fabricated out of a ferromagnetic material, such as steel, an alternate way of releasably retain the hook sections in deployed and stowed positions, is by permanently magnetizing the bar body, or the pivotable hook sections, or both. Magnetic attraction between them ensures releasable retention. The bar body does not need to be magnetized as a whole, just its sections directly interfacing with the pivotable hook sections.

In case the bar body or the hook sections are made of non-magnetic materials, a magnetized coating, or film, or a small piece of ferromagnetic material can be embedded in them to achieve magnetic attraction and retention. Such a coating or film may incorporate ferromagnetic materials and compounds, for example, iron or rare earth elements, such as cobalt or samarium.

The adhesive strip 62d and the protective liner 66d are essentially identical to the adhesive strip 62a and protective liner 66a of a previous embodiment.

Additionally, although not shown on Figures, snap fasteners similar to the types commonly employed for garments, can also be used for rotatably attaching the pivoting hook sections to the bar body. In this case, one half of the fastener is attached to the hook section, while the complementary half of the fastener is attached to the bar body. The use of readily available components such as these can significantly decrease manufacturing costs of the device.

Another variation of the bar features retractable hook sections. On FIGS. 22 through 33, the retractable hook sections are made to slide into the main body of the bar, which is formed in such a way as to retain the retractable sections and to support them in their extended and retracted positions.

Figure 23:
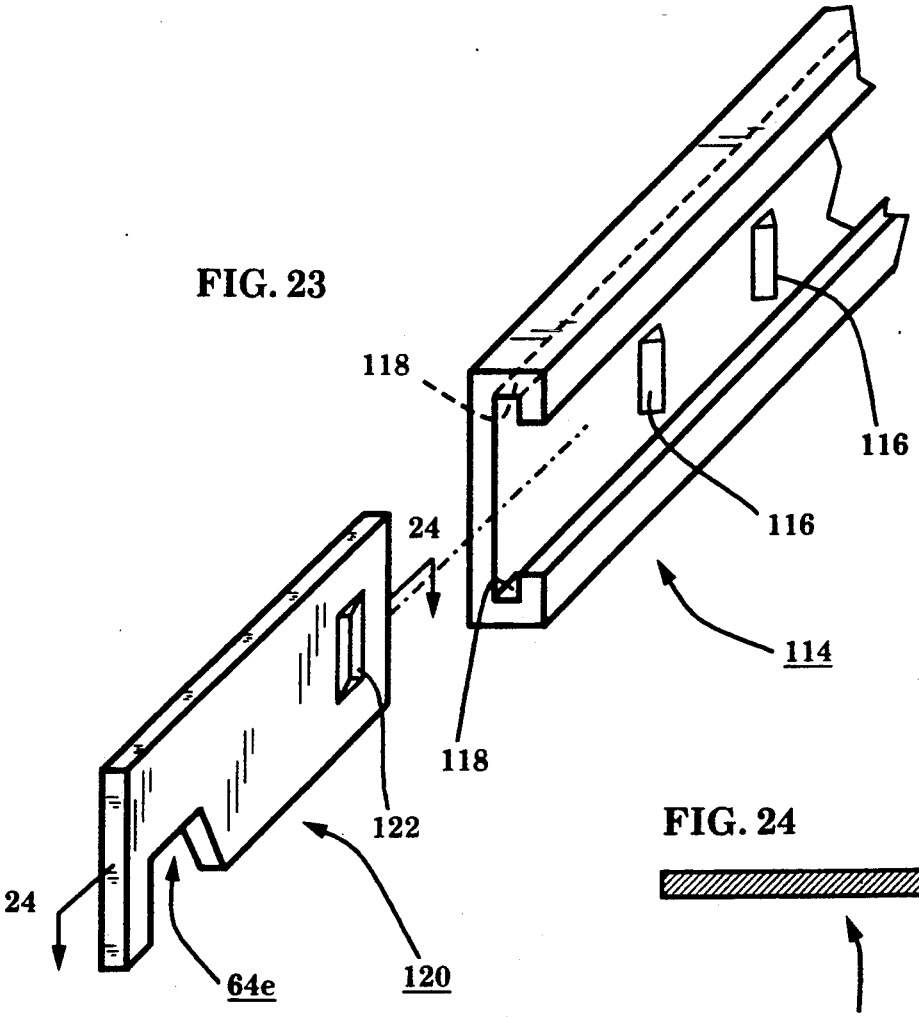
FIG. 23 is a fragmentary perspective view of the bar with slidable hook sections.
Figure 24:
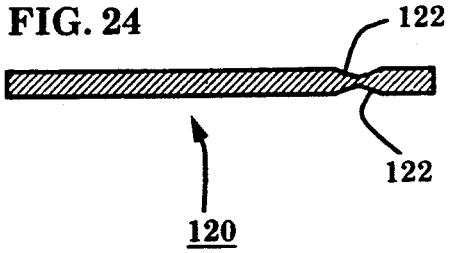
FIG. 24 is cross section taken along the line 24—24 of FIG. 23.
Figure 22:
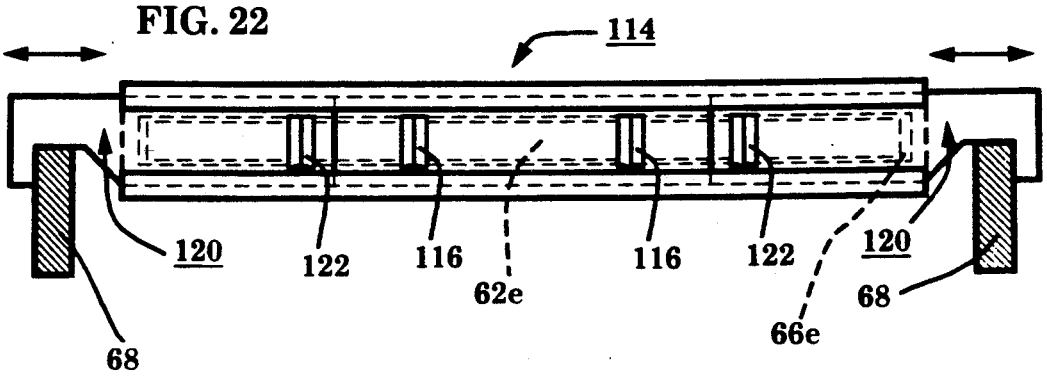
FIG. 22 is a plan view of the bar with slidable hook sections.

The bar body comprises a single piece, three-sided, essentially open channel with longitudinal grooves in the upper and lower sides. FIGS. 22 through 24 show a single piece open-channel bar body 114 into which essentially flat slidable hook sections 120 are inserted. The bar body as well as the slidable hook sections are made preferably of plastic, but other materials, such as metal can be also used.

The hook sections 120 are contained in the bar channel inside the grooves 118 in the channel side walls, and are releasably retained in extended and retracted positions by the integrally formed projections 116 which engage detents 112 of the slidable hook sections. There are four projections 116 on the bar channel, two on each end, to provide said retentiı›n of the hook sections.

Advantageously, due to its open channel construction, the bar body can be formed by extrusion and cutting of continuous plastic channel with subsequent formation of the projections by stamping, or it can be formed by folding the edges of a continuous strip carrying prefabricated projections, so as to create a continuous channel body, an then separating it into individual bar bodies. The bar body can also be fabricated using an injection-molding process.

The hook sections 120 contain hook openings 64e which are similar to elements 64a of the embodiment 84, and are made to engage the two parallel suspension rails 68 of a suspension file drawer or cabinet. Detents 122 are included on each side of a slidable hook section 120 to make the sections usable on either end of the bar. In addition, the detents can be used advantageously as finger grips for sliding the hook sections inside the channel.

The bar body also contains the adhesive strip 62e and the protective liner 66e which are essentially identical to the adhesive strip 62a and release the liner 66a of the embodiment 72.

Figure 25:
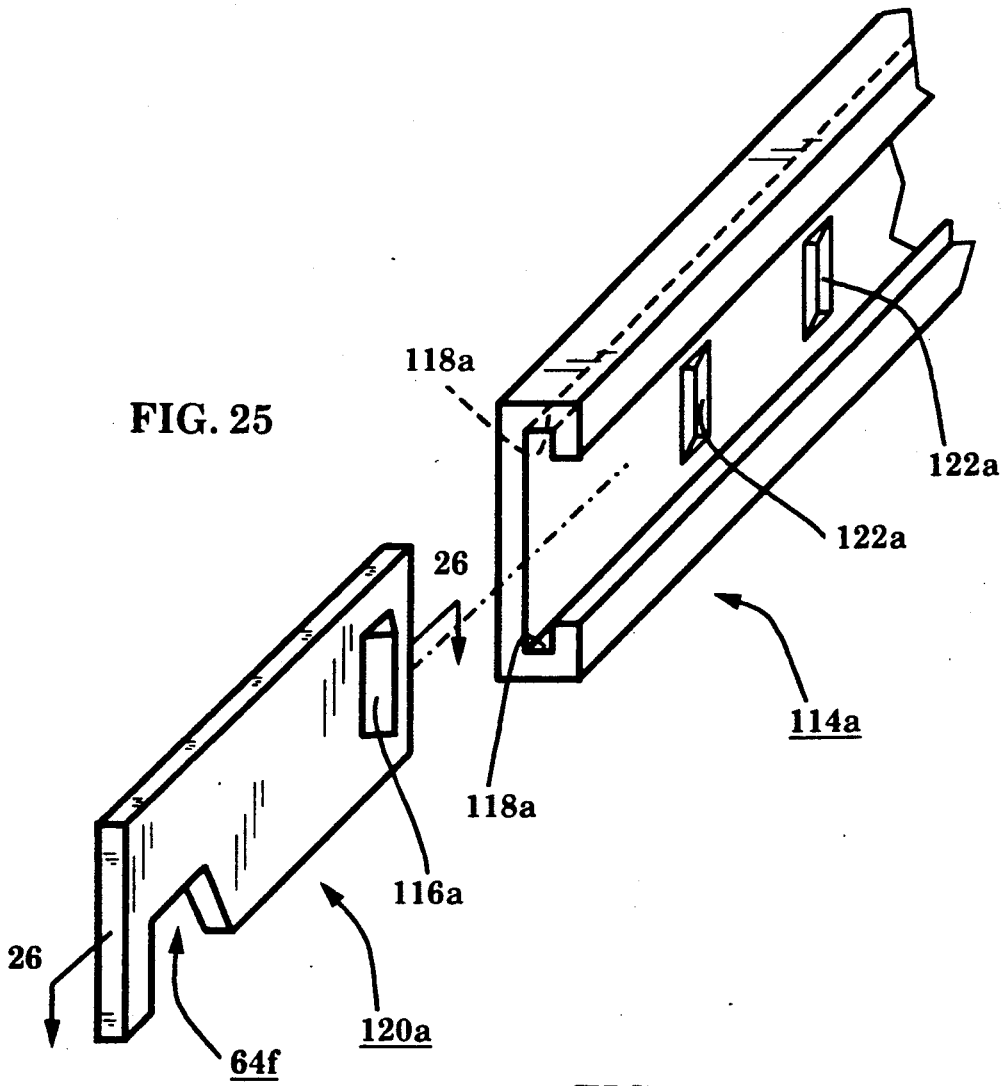
FIG. 25 is a fragmentary perspective view of another version of the bar with slidable hook sections.
Figure 26:
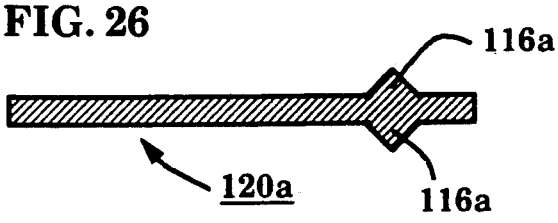
FIG. 26 is a cross section taken along the line 26—26 of FIG. 25.
Figure 32:
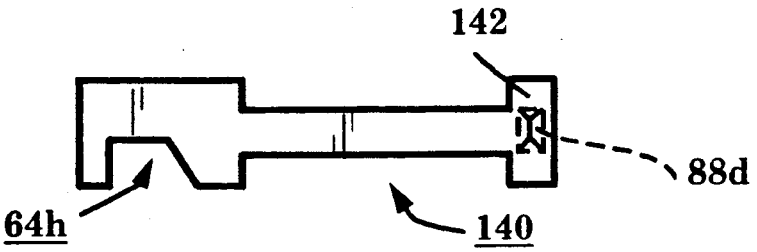
FIG. 32 shows a slidable hook section.
Figure 31:
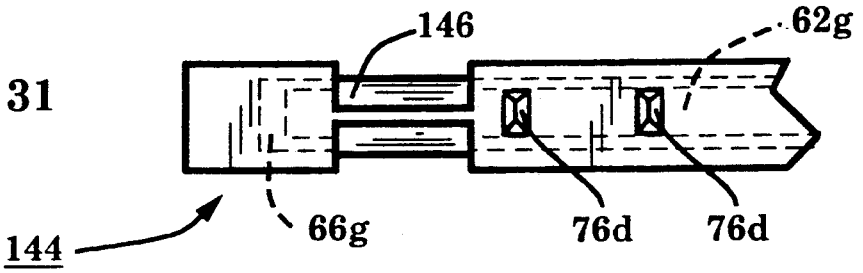
FIG. 31 is a fragmentary plan view of the bar body with folded channels.
Figure 30:
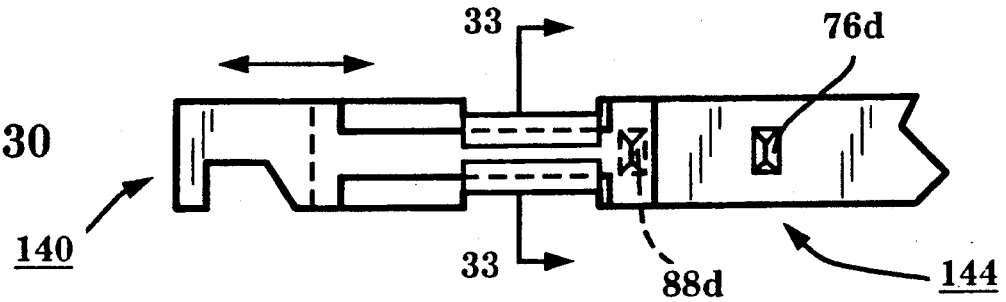
FIG. 30 is a fragmentary plan view of yet another version of the bar with slidable hook sections which also has integral folded channels.
Figure 33:
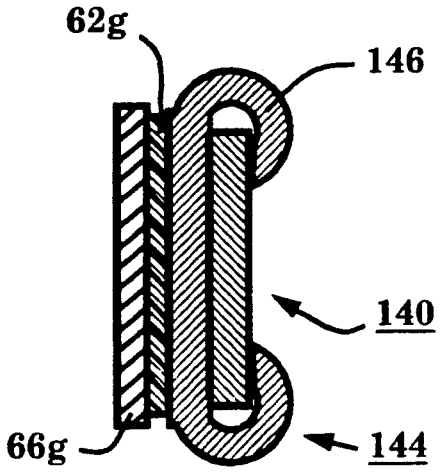
FIG. 33 is a cross section taken along the line 33—33 of FIG. 30.

FIGS. 25 and 26 show a variation of the previous embodiment, whereby the detents and projections are effectively interchanged between the slidable hook sections 120a and the bar body 114a. There are four detents 122a in the channel of the bar body, and there are two projections 116a on each slidable hook section 120a, along with a hook opening 64f. As with the previous embodiment, the reason for the two opposing projections on the hook section is to make the sections usable on both ends of the bar, with an added benefit of using the exposed detent as a finger grip for sliding the hook section inside the channel.

The bar body also contains an adhesive strip and a protective liner similar to the ones used in previous embodiments, although they are not shown in the drawings.

FIGS. 27 through 29 show yet another variation of the bar with slidable hook sections, whereby each hook section 120b contains projection 116b on one side, and detent 122b on the opposite side. The bar body 114b, in turn contains two projections 116b on one end, and two detents 122b on the other. Just as the bar with pivotable hook sections described earlier, this embodiment advantageously utilizes only a single type of the hook section, hence a hook section is usable both on the left and the right sides of the bar body.

Each slidable hook section 120b, also contains a hook opening 64n essentially identical to a hook opening 64a of the embodiment 72, and the bar body has an adhesive strip 62i and the protective liner 66i which are essentially identical to the adhesive strip 62a and release the liner 66a of that embodiment.

FIGS. 30 through 33 show yet another embodiment of a bar with slidable hook sections. The bar body 144 is preferably made of an essentially flat metal strip, and a somewhat short channel is formed on each end by partially folding of portion of the strip on itself to form channel walls 146.

Slidable hook section 140, which is also made preferably of metal strip, and preferably of the same type of strip from which the body of the bar is fabricated, has integral stop 142, and hook opening 64h which are preferably both formed in the same operation.

Additionally, the bar body 144 contains four detents 76d, two to each end of the bar, similar to the elements 76 of the previous embodiment. These detents interface with projections 88d on hook sections 140, to releasably secure the hook sections in their extended or retracted positions. These detents and projections are interchangeable, that is, the projections can be placed on the bar body, and detents on the hook sections, without diminishing their captive function.

The assembly of the device can be effected by first positioning the hook sections on the bar body and subsequently folding of the channel walls 146, which then slidably retain hook sections.

Alternatively, the body of the bar can be made of plastic, with the channel walls 146 fabricated via molding operation and made somewhat compliant to permit the insertion of the hook sections which also can be made of plastic or metal. The operation of this bar assembly is essentially identical to the one's described above.

The bar body also contains an adhesive strip 62g, and a protective liner 66g essentially identical to the ones used in previous embodiments.

As in the previous embodiment with pivoting hook sections, the body of the bar and the hook sections of this embodiment can be magnetically retained in deployed and stowed positions.

In another embodiment of the suspension bar, shown on FIGS. 34 through 39, the hinged hook sections 130 are integral with the bar body 128 and are made to hinge transversely with respect to the longest dimension of the bar, so as to fold for stowage.

Figure 34:
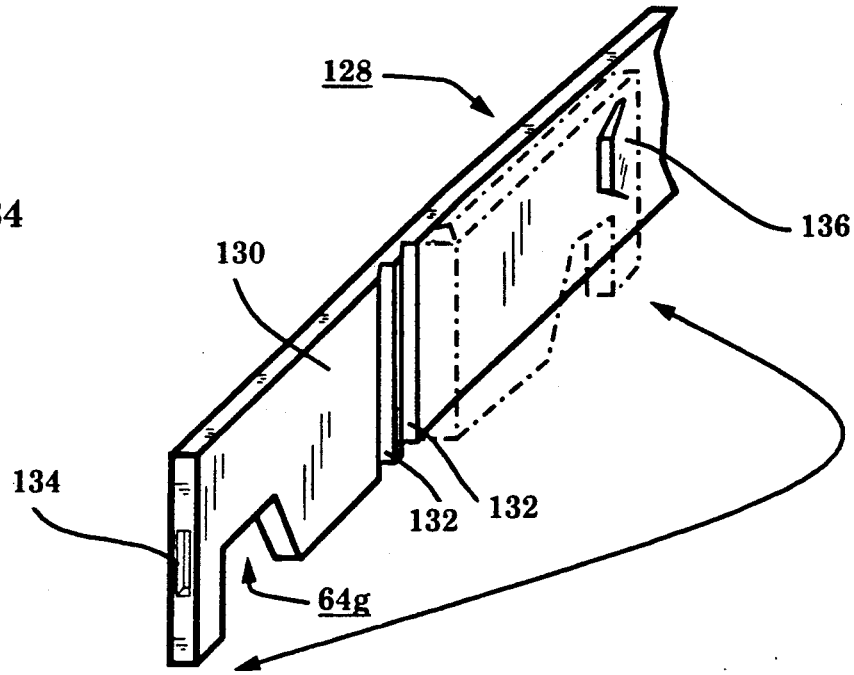
FIG. 34 is a fragmentary perspective view of the bar with integral hinged hook sections.
Figure 35:
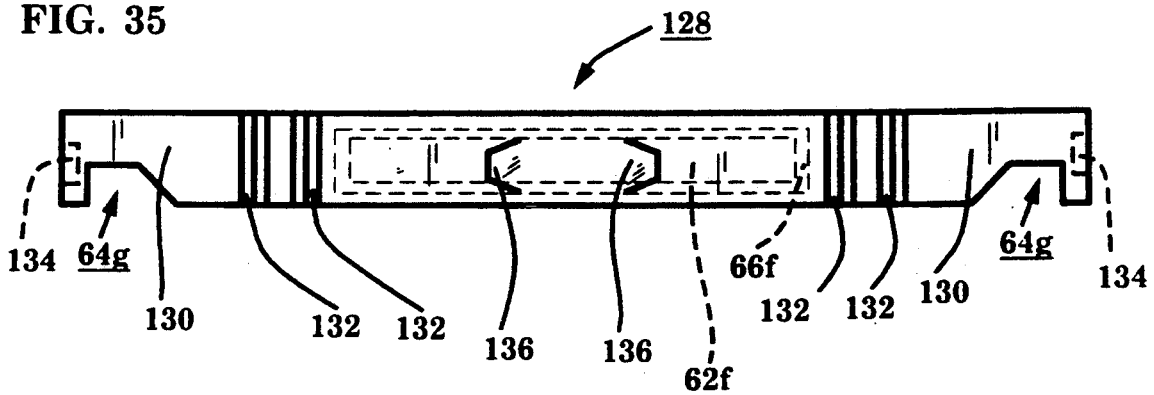
FIG. 35 is plan view of the bar with integral hinged hook sections.
Figure 36:
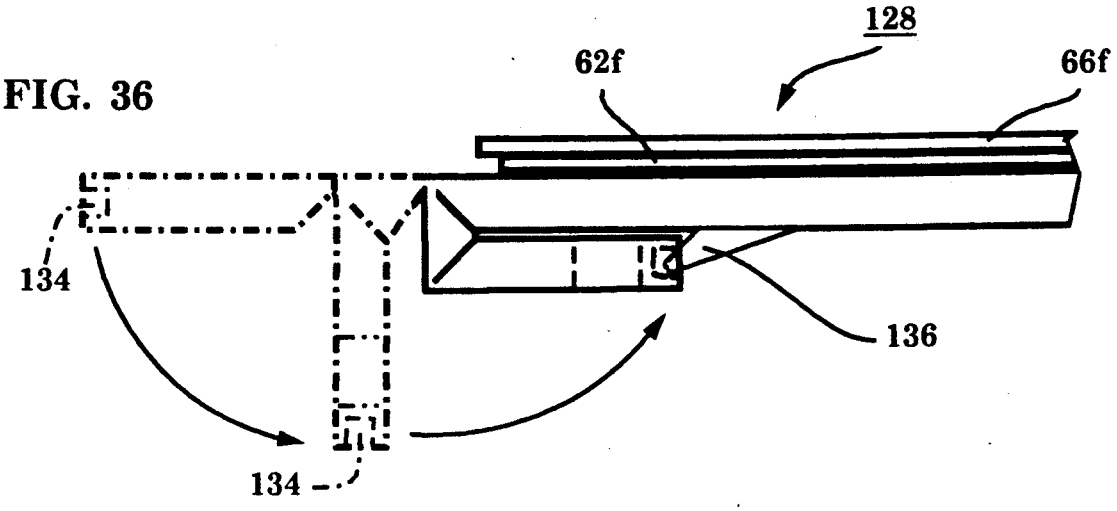
FIG. 36 shows successive folding and locking of the hinged hook sections of the bar.
Figure 37:
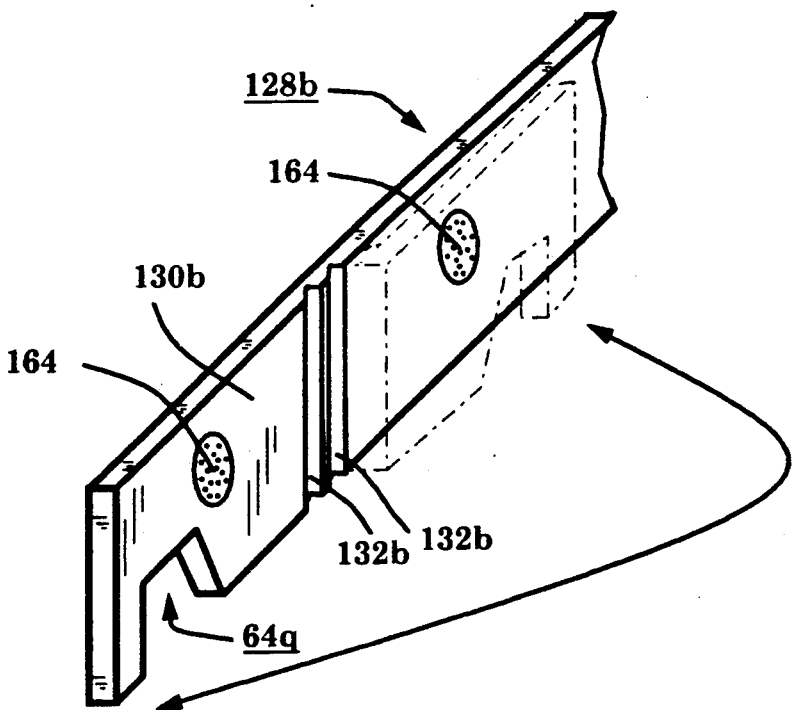
FIG. 37 shows a fragmentary perspective view of the bar with retainers for releasably securing the integral hinged hook sections on the bar body.
Figure 38:
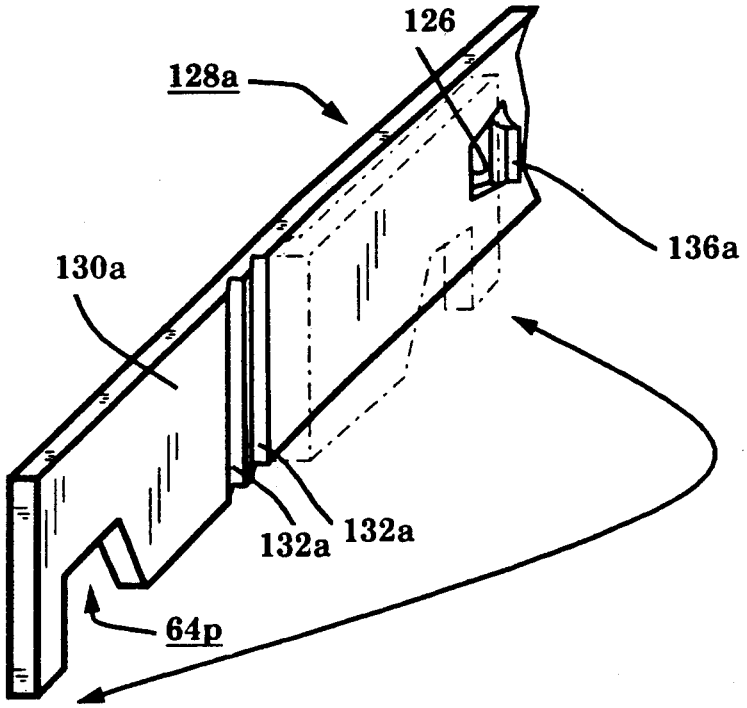
FIG. 38 shows a fragmentary perspective view of the bar with integral hinged hook sections and having a U-shaped slit with compliant latch.
Figure 39:
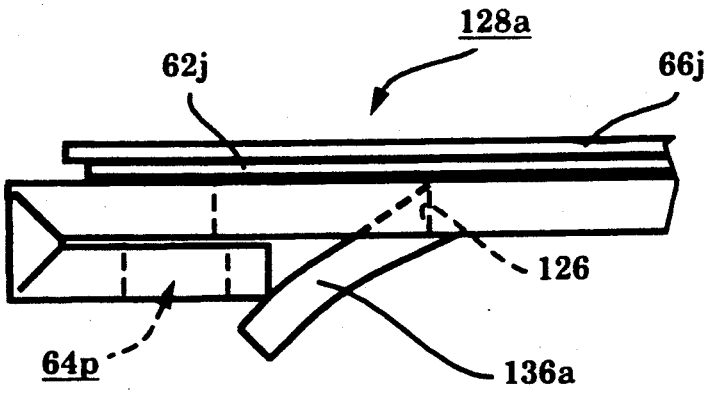
FIG. 39 shows a fragmentary elevation view of the folded hook section of the bar while it is being secured by a latch.

In one embodiment shown on FIGS. 34 through 36 the hook sections are releasably secured in stowed position by integral compliant latches 136 engaging detents 134 which are advantageously provided for this purpose in the edges of the hook sections 130.

To facilitate folding of the hook sections, V-shaped grooves 132 on each end of the bar are optionally provided. If two grooves are used on each end of the bar body, the angle of each groove should be essentially greater than or equal to 90 degrees to ensure adequate folding of the hook sections. If several grooves are used on each end of the bar, their individual angles measured in degrees should be no smaller than 180 divided by N, where N is the number of grooves on each end of the bar. The depth of the grooves depends on the mechanical properties of the bar material, and should be made sufficient to allow repetitive bending of the bar at the grooves while avoiding breakage. The steps for folding the hinged hook section 130 are shown on FIG. 36.

The hinged hook sections 130 contain hook openings 64*g*, and the bar has an adhesive strip 62*f*, and protective liner 66*f* similar to the respective elements of previous embodiments.

The bar in this embodiment is preferably made of plastic by a molding process, or of a heavy cardboard. In the latter case, in the embodiment 128*a* shown on FIG. 38 the grooves 132*a* can be formed by scoring the cardboard, and the latches can be made by cutting a U-shaped or V-shaped slit 126 through the body of the bar, and outwardly lifting thus defined latch 136*a*. The detent in the hook section in this case is not necessary as the latch spans the relatively thin cardboard of the hook section, as shown on FIG. 39.

In all embodiments with integral hinged hook sections the distance between the hinge sites on the bar body is preferably such that the sites lie inside the booklet. This way, when the hook sections are in the deployed position, and the booklet is hung from the filing suspension rails, additional stability is provided by the sides of the booklet.

The hinged hook sections 130*a* contain hook openings 64*p*, and the bar has an adhesive strip 62*j*, and a protective liner 66*j* similar to the respective elements of previous embodiments.

Instead of latches, alternate retainers can be employed to releasably secure the hook sections in the stowed position. The retainers, denoted 164 in the embodiment 128*b* on FIG. 37, can be patches of low-tack adhesive, similar to the already mentioned POST-IT brand adhesive by the 3M Company, applied to the bar body, or the hook sections, or both.

Conversely, the retainers 164 may comprise tabs of a hook-and-loop type fastener, widely used in garment industry, mounted on the bar body and the hook sections in such a way that in the stowed positions of the hook sections the fasteners on them face complementary fasteners on the bar body and are able to interlock.

Alternatively, retainer 164 may comprise a tab of a permanently electrostatically charged thin plastic film. Such electrically charged plastic materials are generally known as ferroelectrics. The plastic material, for example, can be PTFE, similar to the material used for the protective liner. One such tab can suffice to attract and to hold the hook section to the bar body via an electrostatic attraction between the tab and the material of the bar body. For even greater holding force, a second retainer, oppositely charged electrically, can be mounted on the bar body.

Snap fasteners, similar to the types commonly employed for garments, can also be used as retainers for the hook sections. In this case, one part of the fastener is attached to the hook section, while its complementary part is attached to the bar body.

Also, a permanently magnetized coating or film applied to the hook sections and to the bar body can be used for the same purpose, provided the magnetization directions are opposite for the coating on the hook section and the one on the bar body. The magnetic materials used in the coating can be similar to the ones already suggested for the bar embodiment with pivoting hook sections.

In the embodiment 128*b* hinged hook sections 130*b* containing hook openings 64*q* are essentially identical to the corresponding elements of previous embodiments. Although not shown on the Figure, an adhesive strip and protective liner similar to the ones used in previous embodiments are included at the back of this bar assembly.

For additional rigidity, the hook sections can me made thicker than the rest of the bar to enhance its load-bearing capacity. Reinforcement can be accomplished by an additional layer of cardboard or other material on the hook end, in case of a cardboard bar, or by molding thicker hook sections on the plastic bar. Additional reinforcement ribs can also be molded on the hook sections and the bar body.

The last three embodiments of the bar mentioned above, especially when fabricated out of cardboard, due to their low cost and relatively narrow shape are particularly suited for use with small, inexpensive booklets with limited useful life. It can also be used to hang single sheet documents by attaching them by the edge directly to the bar with the adhesive strip.

In other embodiments of the suspension bar, shown on FIGS. 40 through 60, the hinged hook sections are fabricated separate from the bar body 128 and are made to pivot transversely with respect to the longest dimension of the bar. Both the hook sections and the bar body are preferably made out of plastic.

In several embodiments the hook sections contain pivot shafts interfaceable with pivot shaft supports on the bar body, while in other embodiments the bar body itself has a pivot shaft or shafts, and the hook sections contain shaft supports. Just as in previous embodiments of the bar with integral hinged hook sections, in these embodiments the distance between the hinge sites on the bar body, corresponding to the pivoting axes of the hook sections, is preferably such, that the sites lie inside the booklet. This way, when the hook sections are in the deployed position, and the booklet is hung from the filing suspension rails, additional stability is provided by the sides of the booklet.

Furthermore, to secure the hook sections in the stowed and deployed positions, compliant latches, as well as combinations of detents and projections are provided on the body of the bar and the hook sections.

Figure 40:
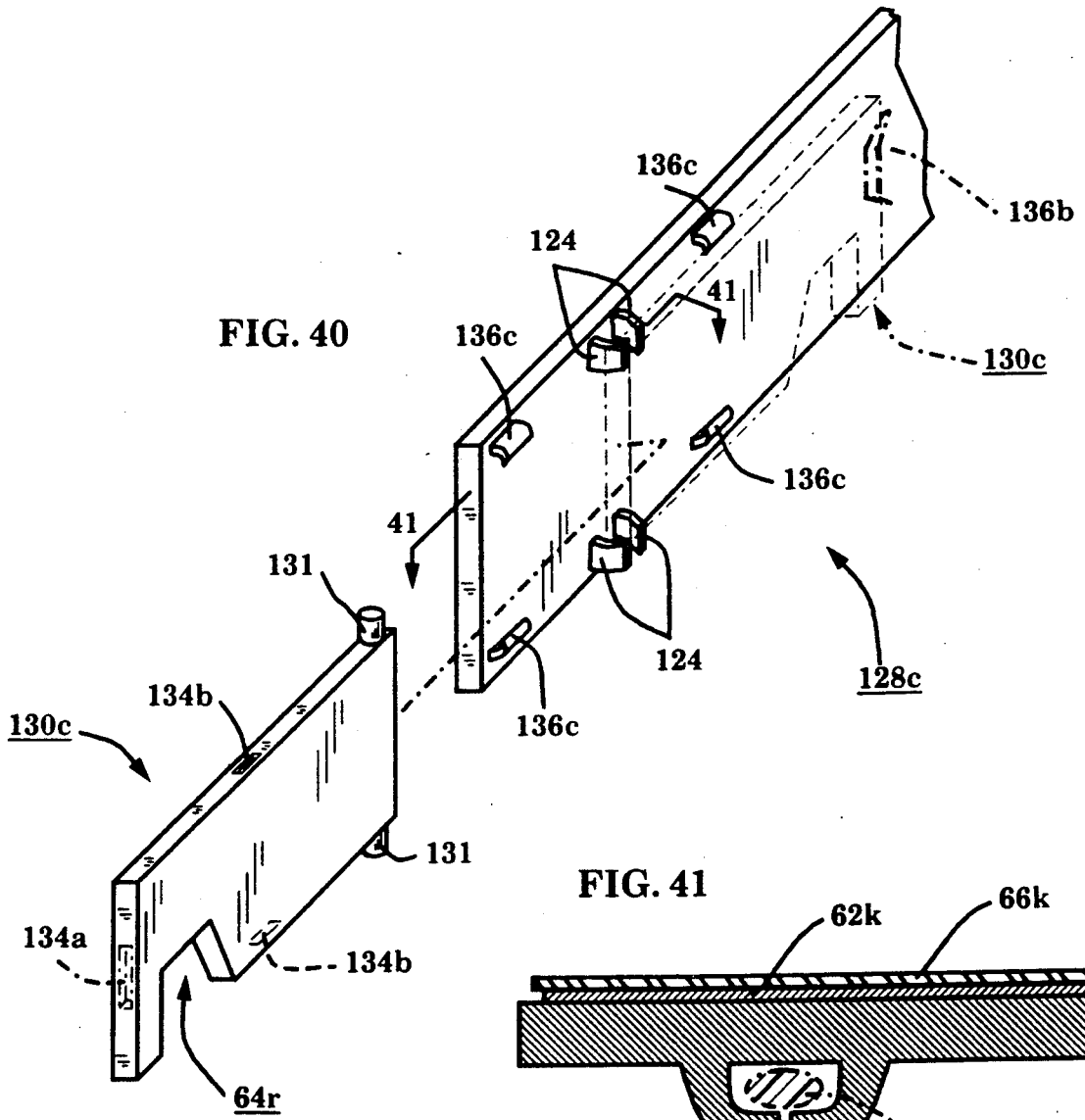
FIG. 40 shows a fragmentary perspective view of the bar with separate hinged hook sections interfaceable with the pivot shaft retainers on the body of the bar.
Figure 41:
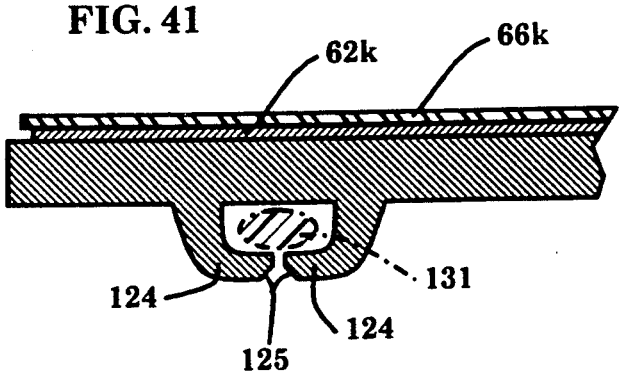
FIG. 41 shows a partial cross section of the bar body taken along the line 41—41 on FIG. 40. It illustrates the interaction of a pivot shaft of the hook section and a pivot shaft retainer.

In the bar embodiment on FIGS. 40 and 41, the essentially flat bar body 128*c* contains pivot shaft supports 124 which interface with the pivot shafts 131 on the pivotally hinged hook section 130*c*. The pivot shaft supports are made to be rather compliant, so that the shafts 131 on the hook section can be inserted in place via a 'snap-fit' operation during the device assembly. To further facilitate the assembly process, the supports are provided with slanted entrance faces 125 which improve the insertion of the pivot shafts.

As further shown on FIG. 41, the pivot shafts 131 can be made essentially oval in cross section so they tend to spread the compliant supports when the hook section is rotated between its stowed and deployed positions. The clamping action of the shaft supports thus forces the hook section into deployed or a stowed position, even when the latches are not engaged.

Compliant latches 136c interface with the detents 134b on the hook section to releasably secure the latter on the bar body in the stowed and deployed positions. An optional latch 136b, similar to the latch 136 of embodiment 128, and a corresponding detect 134a can also be provided for added holding power for the stowed hook section.

The bar body also contains the adhesive strip 62k and the protective liner 66k which are essentially identical to the adhesive strip 62a and release the liner 66a of the embodiment 72, while the hook section contains a hook opening 64r similar to the 64a of the same embodiment 72.

Figure 42:
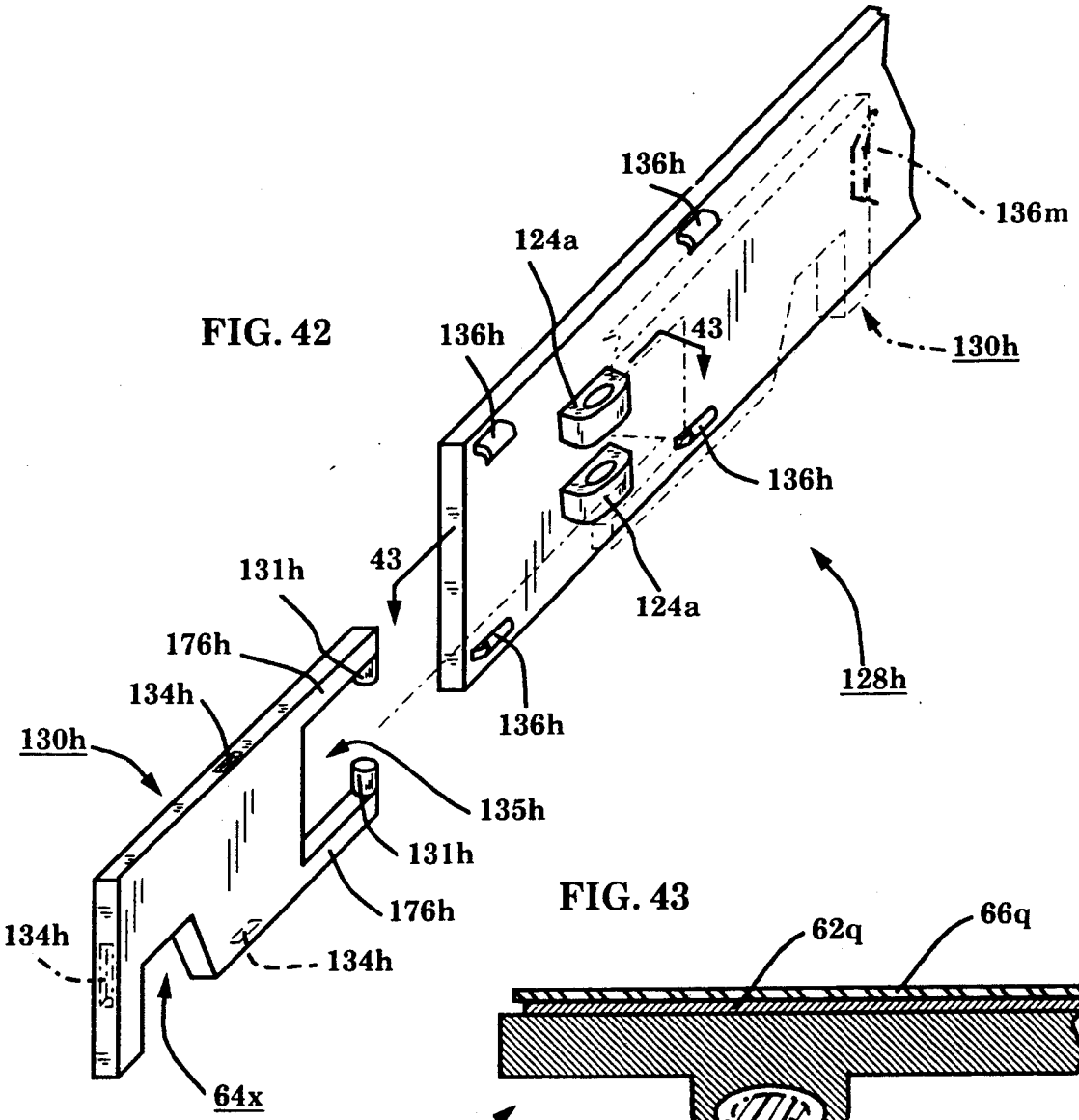
FIG. 42 shows a fragmentary perspective view of a variation of the bar with alternate hinged hook sections and pivot shaft retainers.
Figure 43:
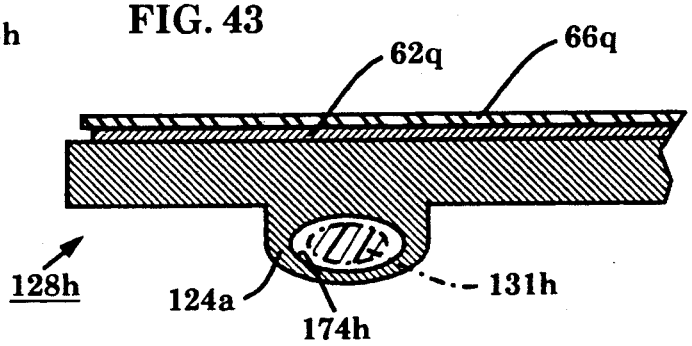
FIG. 43 shows a partial cross section of the bar body taken along the line 43—43 on FIG. 42. It also illustrates the interaction of a pivot shaft of the hook section and a pivot shaft retainer.

FIGS. 42 and 43 show another embodiment of the bar with separate hinged sections. The bar body 128h contains pivot shaft supports 124a which contain essentially oval holes 174h with somewhat thin and compliant outer wall. As in the previous embodiment, the pivot shafts 131h on the hook sections are also made oval, with the longest axis in the lateral direction to facilitate detention in the stowed and deployed positions of the hook section.

The pivotally hinged hook section 130h contains an opening 135h which effectively defines two compliant beams 176h on which pivot shafts 131h are located. During assembly of the device, these compliant beams can be flexed to permit insertion of the pivot shafts into the shaft supports on the bar body, where they are rotatably retained thereafter by the clamping action of the compliant beams.

This embodiment further contains elements 62q, 66q, 64x, 134h, 136h, and 136m which are essentially identical to the respective elements 62k, 66k, 64r, 134b, 136c, and 136b of the embodiment 128c.

Figure 44:
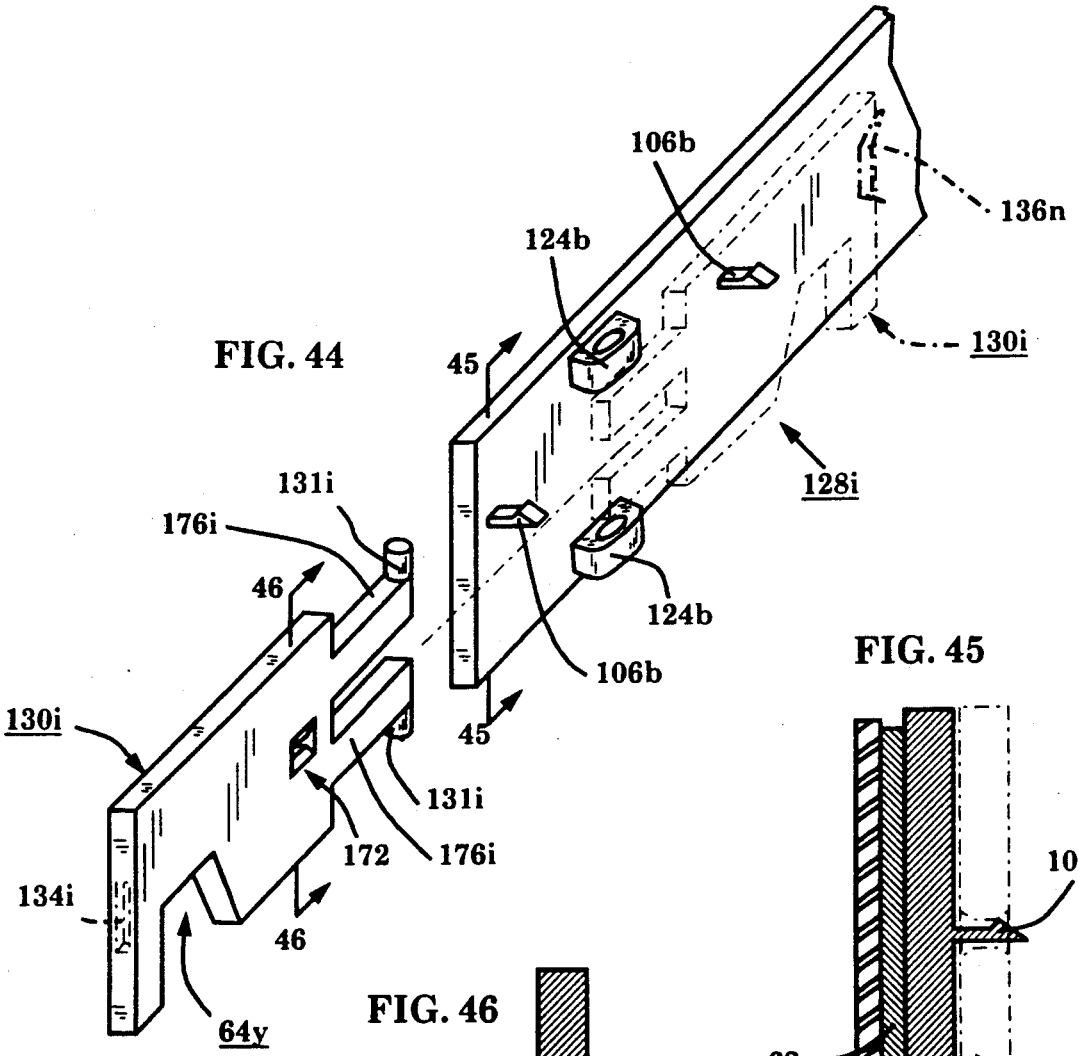
FIG. 44 shows a fragmentary perspective view of yet another embodiment of the bar with alternate separate hinged hook sections and pivot shaft retainers.
Figure 45:
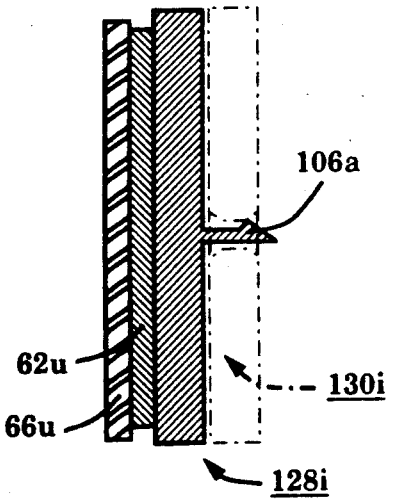
FIG. 45 shows cross section of the bar body taken along the line 45—45 on FIG. 44. It illustrates the interaction of a pivot shaft of the hook section and compliant locking tang.
Figure 46:
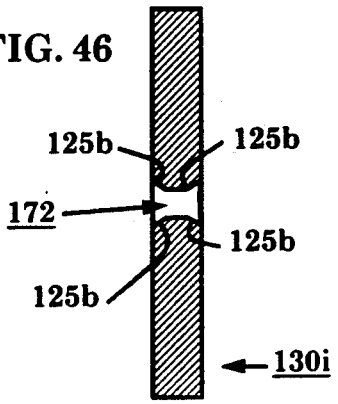
FIG. 46 shows cross section of the hinged hook section taken along the line 46—46 on FIG. 44, and particularly shows the construction of the opening for the locking tang.
Figure 47:
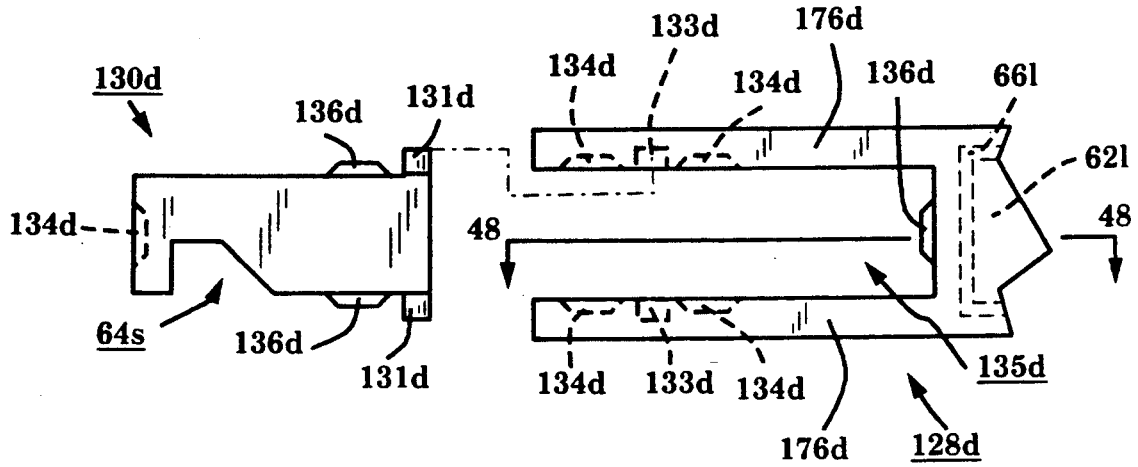
FIG. 47 is a partial plan view of a variation of a bar with separate hinged hook sections, whereby the bar body has elongated openings to permit compact stowage of the hook sections.
Figure 48:
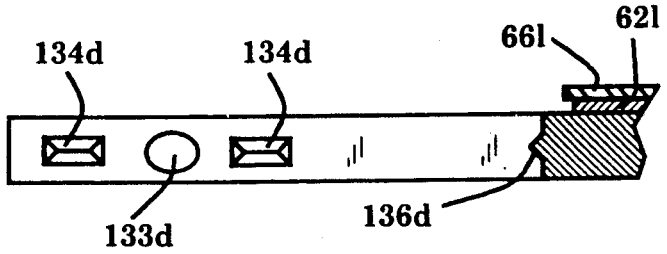
FIG. 48 is a partial cross section taken along the line 48—48 on FIG. 47.

Another embodiment of the bar with pivotally hinged hook sections is shown on FIGS. 44 through 46. It differs from the previous embodiment in that instead of latches, the bar body 128i contains compliant locking tangs 106b which interface with the corresponding openings 172 on the pivotally hinged hook sections 130i. The shape of the tip of each tang facilitates easy entrance into the opening on the hook section, and releasable locking. The openings 172 contain inclined entrance faces 125b, which also facilitate the entrance, locking and unlocking of the tangs. Other retainers can be used to secure the hook sections in the stowed and deployed positions, provided they are releasable. Retainers similar to already described in conjunction with earlier embodiments of the bar can be used.

The pivoting shafts 131i of the hook sections are essentially similar to the shafts of the previous embodiment, in that they are essentially oval in cross section. They are also situated on the compliant beams 176i which can be flexed during the assembly of the device to permit the insertion of the pivot shafts into the shaft supports 124b on the bar body, which are essentially identical to the supports 124a of the prior embodiment 128h.

This embodiment further contains elements 62u, 66u, 64y, 134i, and 136n which are essentially identical to the respective elements 62q, 66q, 64x, 134h, and 136m of the embodiment 128h.

The embodiments on FIGS. 47 through 60 feature variations of a bar with separate pivotally hinged hook sections, whereby the bar body contains openings on each end to permit a more compact stowage of the hook sections then in the previous embodiment. Several detent and projection combinations are furthermore utilized to secure hook sections in deployed and stowed positions.

FIGS. 47 through 50 show a representative embodiment. The pivotally hinged hook section 130d contains pivot shafts 131d, projections 136d, and a detent 134d. The bar body 128d has an elongated opening 135d on each end which defines compliant beams 176d. On each end the bar body further contains four detents 134d, a projection 136d and two pivot shaft depressions 133d. The pivot shafts and the pivot shaft depressions are essentially oval in cross section with the major axes of the ovals in the lateral direction, to provide an added detent action when the hook section is in its stowed or deployed positions, while detents 134d and the corresponding projections 136d provide locking of the hook sections.

Figure 49:
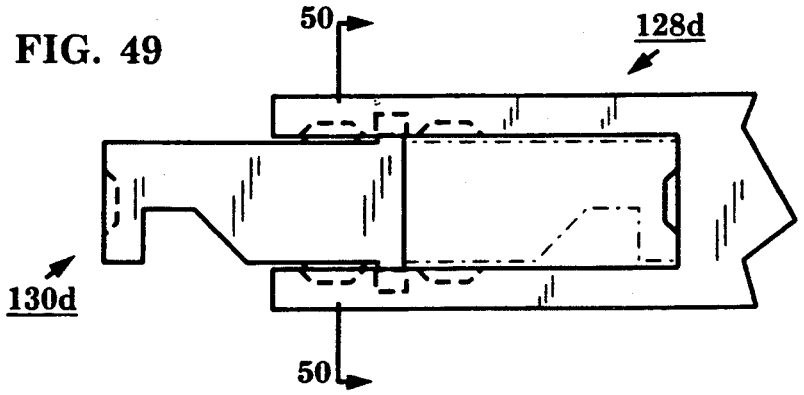
FIG. 49 is a partial plan view of an assembled bar and a hook section with the hook section in deployed position.
Figure 50:
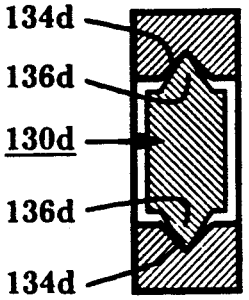
FIG. 50 is cross section taken along the line 50—50 on FIG. 49.

As shown on FIG. 49 the hook section 130d pivots on the pivot shafts and can be extended past the distal end of the bar, or stowed inside the bar body.

The bar body further contains an adhesive layer 62l, and a protective removable layer 66l which are essentially identical to the corresponding elements 62a and 66a, of the embodiment 72. The hook section 130d contains an opening 64s similar to the 64a of the same embodiment 72.

Figure 51:
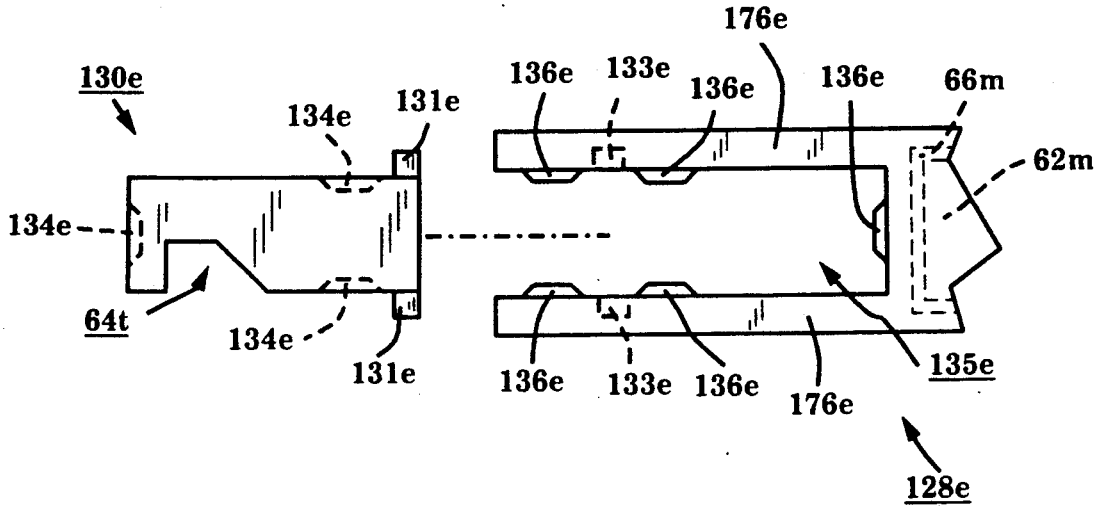
FIG. 51 is a partial plan view of a variation of a bar with separate hinged hook sections.
Figure 52:
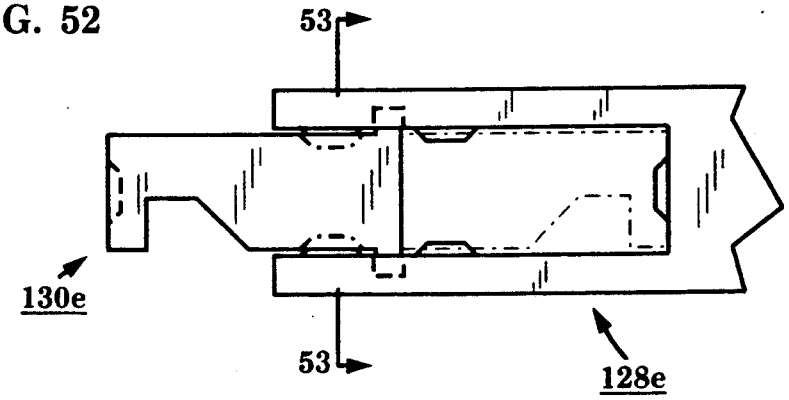
FIG. 52 is a partial plan view of an assembled bar and a hook section with the hook section in deployed position.
Figure 53:
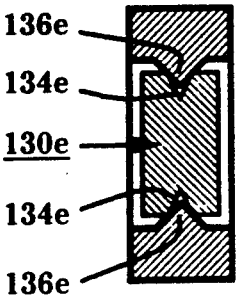
FIG. 53 is cross section taken along the line 53—53 on FIG. 52.
Figure 54:
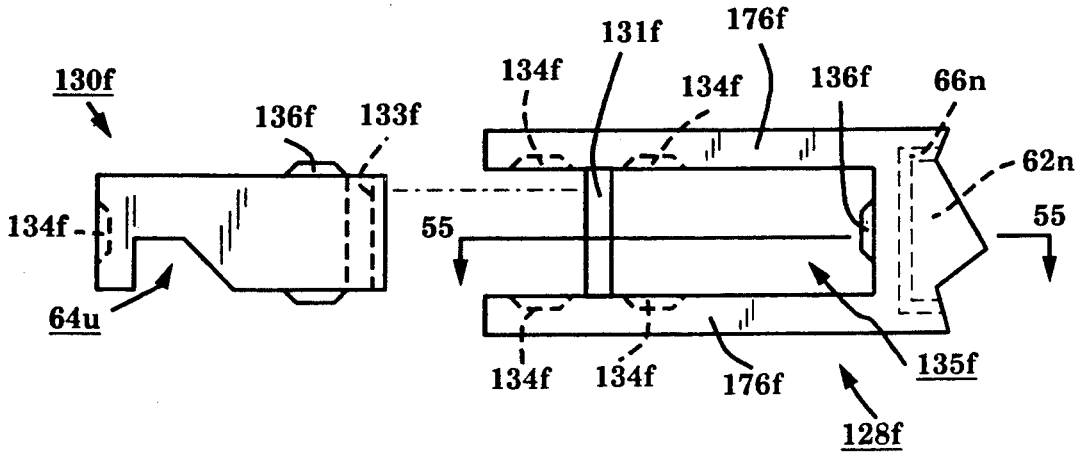
FIG. 54 is a partial plan view of a variation of a bar with separate hinged hook sections.

FIGS. 51 through 53 show a variation of the previous embodiment 128d. In it, the projections 136d on the hook sections are replaced with detents 134e, which interface with corresponding projections 136e on the bar body 128e.

This embodiment further contains elements 62m, 66m, 64t, 130e, 131e, 133e, 134e, 135e, 136e and 176e which are essentially identical to the respective elements 62l, 66l, 64s, 130d, 131d, 133d, 134d, 135d, 136d and 176d of the embodiment 128d.

FIGS. 54 through 57 show yet another variation of the embodiment 128d. In it, each hook section 130f contains a pivot shaft channel 133f, which has an essentially oval cross section and in addition has a narrow longitudinal slot extending the full length of the channel. The thickness of the hook section and the width of the channel are such that the walls of the channel are rather thin and compliant, thus permitting the 'snap-fit' assembly of the hook section 130f onto the pivot shaft 131f of the bar body 128f. The slanted entrance faces 125a of the pivot shaft slot further facilitate the insertion of the hook section.

Figure 55:
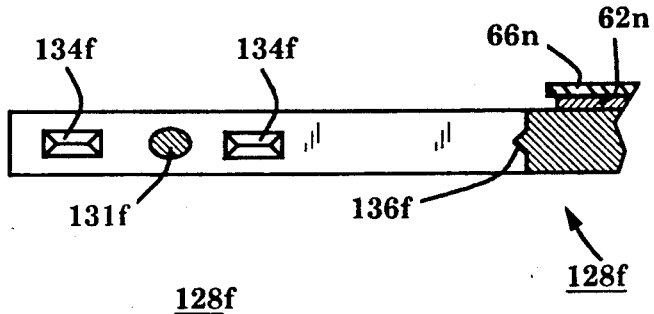
FIG. 55 is a partial cross section taken along the line 55—55 on FIG. 54.
Figure 56:
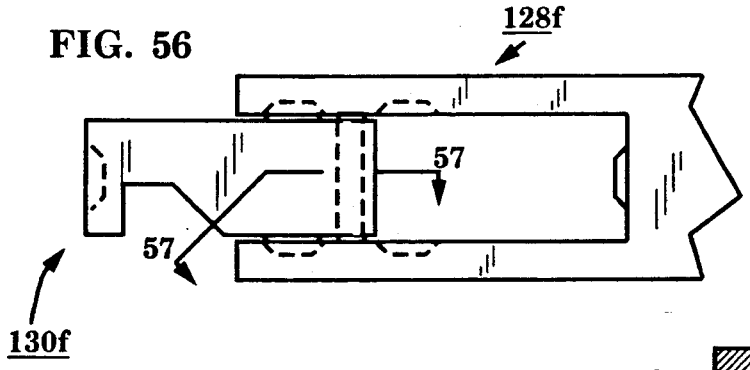
FIG. 56 is a partial plan view of an assembled bar and a hook section with the hook section in deployed position.
Figure 57:
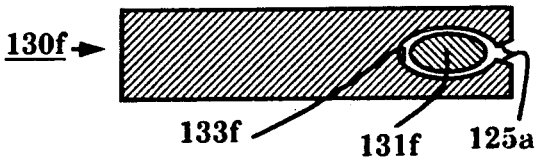
FIG. 57 is cross section taken along the line 53—53 on FIG. 52 and particularly illustrates interaction of a hinged hook section and a pivot shaft on the bar body.

The pivot shaft 131f is also essentially oval in cross section, as shown on FIGS. 55 and 57, to provide further retaining action for the hook section in the stowed and deployed positions. It is preferably created during the molding operation and is an integral part of the bar body.

This embodiment further contains elements 62n, 66n, 64u, 134f, 135f, and 136f which are essentially identical to the respective elements 62m, 66m, 64t, 134e, 135e, and 136e of the previous embodiment 128e. The beams 176f are essentially similar to the beams 176e of the embodiment 128e, but they are not required to be compliant, since insertion of the hook sections does not depend on this quality.

Figure 58:
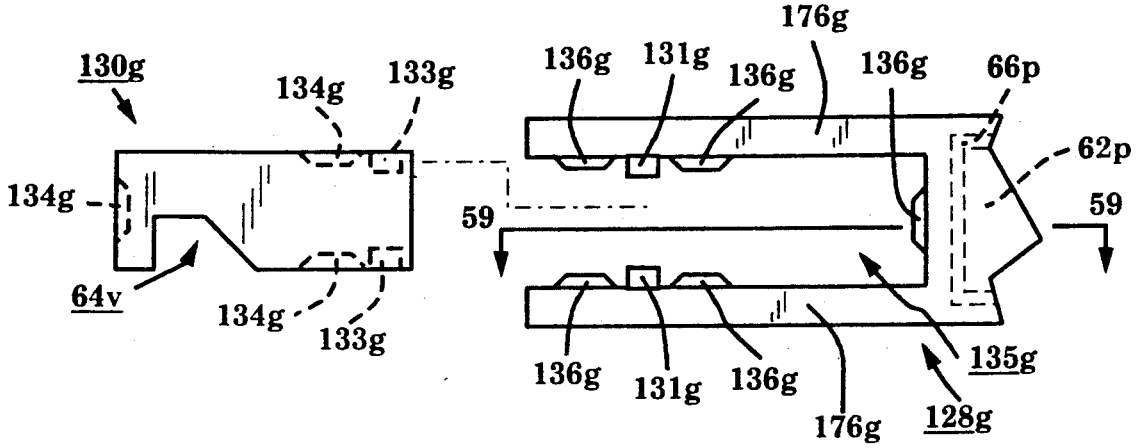
FIG. 58 is a partial plan view of a variation of a bar with separate hinged hook sections.
Figure 59:
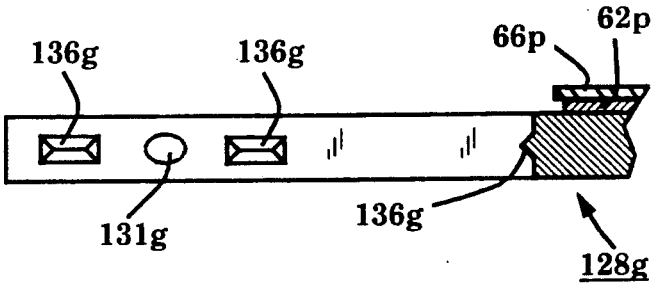
FIG. 59 is a partial cross section taken along the line 59—59 on FIG. 58.
Figure 60:
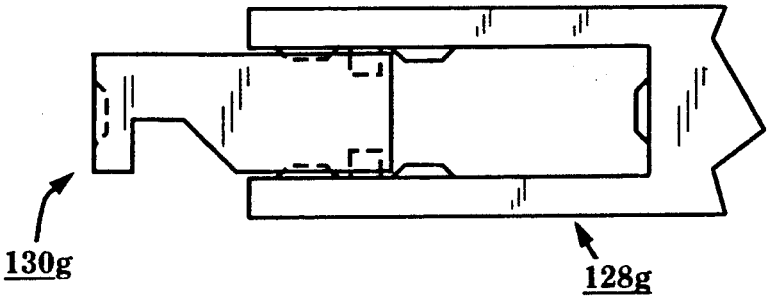
FIG. 60 is a partial plan view of an assembled bar and a hook section with the hook section in deployed position.
Figure 63:
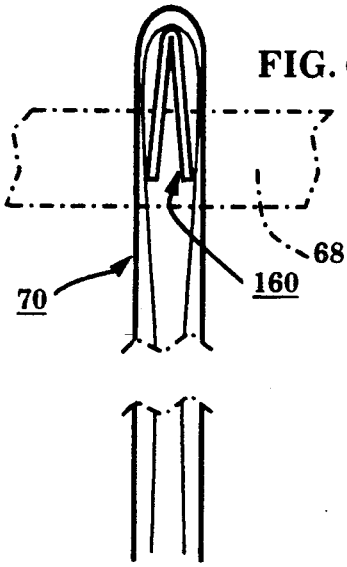
FIG. 63 is an end view of the bar in the booklet
Figure 61:
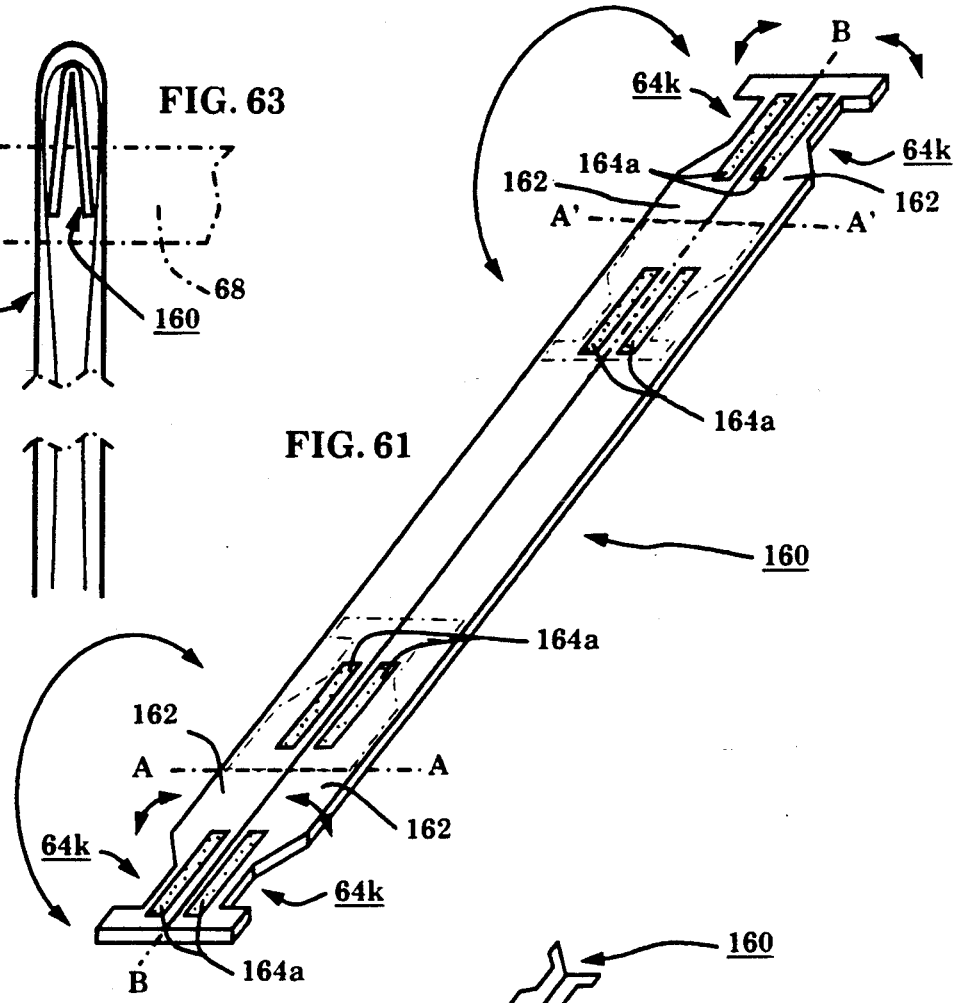
FIG. 61 is a perspective view of the permanently installable foldable suspension bar.
Figure 62:
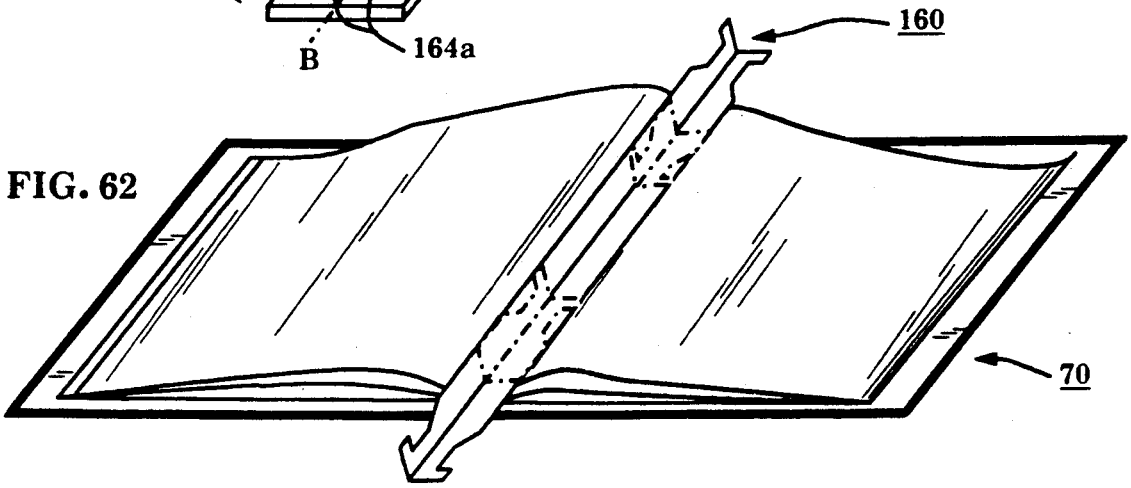
FIG. 62 is a perspective view of the permanent suspension bar installed in a booklet.

Another variation of the above embodiment is shown on FIGS. 58 through 60. In it the hook section 130g contains pivot shaft depressions 133g interfaceable with pivot shafts 131g on the bar body 128g.

The elements 62p, 66p, 64y, 134g, 135g, 136g and 176g are essentially identical to the respective elements 62m, 66m, 64t, 134e, 135e, 136e, and 176e of the embodiment 128e.

It should be noted that other variations of this embodiment of the bar are possible to make by combining and interchanging the pivoting elements, such as shafts, shaft supports, and retainers, such as latches, projections and detents.

Furthermore, depending on the transverse wall thicknesses of the pivot shaft depressions and channels, the amount of their and the pivot shafts' ellipticities, and the material of the bar body and the hook sections, the retaining action of the pivot shaft and pivot depression and channel combinations can be chosen to be quite strong. In this case, other retainers such as latches, detents and projections may prove unnecessary and can be omitted, thus simplifying the construction of the bar.

While the embodiments shown on FIGS. 40 through 60 are preferably fabricated of plastic via a molding process, they can also be made, at least partially, out of metal, or other materials. For instance, the bar body of the embodiment 128c can be fabricated from metal strip via stamping, folding, and piercing operations. Also, because these embodiments feature an adhesive strip which can be used to attach single sheet documents, the bar can be used to file them, provided the bar parts can be fabricated economically.

FIGS. 61 through 65 show yet other embodiments of the suspension bar, whereby the bar can be installed permanently in a booklet, preferably during binding operation. Both embodiments 160 and 166 shown respectively on FIGS. 61 and 64 utilize a somewhat thin, low cost material, such as heavy paper, cardboard, or plastic. The folded bar can be glued inside of the booklet or stapled in it. An adhesive layer similar to 62 of the embodiment 60, can be added to the outer surface of the bar for this purpose. The adhesive can also be protected with a removable protective liner similar to 66 of the embodiment 60.

The laterally foldable, double sided bar 160 contains hinged hook sections 162. The folding of the hook sections for stowage inside the booklet starts with transverse folding of the bar along the hinge lines A—A and A'—A' of FIG. 61, which is followed by the folding of the bar laterally along the B—B line shown in the same Figure.

For filing, the booklet is opened first, the hook sections of the bar are unfolded along the hinge lines A—A, and then inverted along the line B—B. The booklet is then closed and hanged from the suspension rails of the filing drawer by the hook sections.

The length of the hook sections is selected preferably to be such that the hinge sites corresponding to lines A—A and A'—A', lie essentially inside the page boundary of the booklet. This way, when the booklet is suspended, it itself adds support to the bar. In addition, the inverted-V shape that the bar takes after being deployed as shown on FIG. 63, creates a rigid structure capable of supporting the weight of the booklet, while utilizing relatively thin material for the bar construction. Each hook section has an opening 64k which interfaces with a suspension rail 68 of a filing drawer as also shown on FIG. 63.

For very thin and light booklets the bar's inverted-V shape mentioned above may not be necessary, and a narrower bar may be deemed desirable. For this purpose, and to hold the hook sections down to the rest of the bar in stowed position, retainers 164a can be added to the inside of the bar, to releasably hold two halves of the bar body together while the hook sections are deployed. The retainers are essentially identical to 164 of the embodiment 128b on FIG. 37.

An additional benefit can be gained if the retainers 164a are adhesive. The unfolded bar can be used to hang single sheet documents whereby the bar would be applied to the edge of the document sheet, laterally folded over it, and adhesively attached. It may be advantageous, therefore, to make the adhesive retainers to extend through the whole length of the bar body, to effect a better attachment of the document sheet.

Another embodiment of a suspension bar denoted 166 is shown on FIG. 64. It differs from the embodiment 160 above in that it has only a single-element body, the other half of the body being replaced by a mounting tab 170. The tab facilitates mounting of the bar inside the booklet either via gluing or stapling operation. The body of the bar is made of a rigid material, such as cardboard. This type of bar is particularly suitable for light booklets. The mounting tab can be fabricated integrally with the bar body, or it can be attached to it via gluing, for example. If larger booklets are to be filed, the bar can be made of a plastic strip.

The retainers 164b are essentially identical to the retainers 164 and 164a, and are included to hold down the hinged hook sections 168 while the booklet is outside of the filing cabinet and is being used.

Each hook section has an opening 64l which interfaces with a suspension rail 68 of a filing system on FIG. 65. As in the embodiment 160 above, the length of the hook sections is preferably selected to be such that the hinge sites corresponding to lines C—C and C'—C' lie essentially inside the page boundary of the booklet, for an added support to the hook sections in deployed position.

The last two embodiments of the suspension bar, due to their low cost and the fact that a booklet production house, in addition to the end user, can install the bar and thus make it an integral part of a booklet, create an added advantage for the booklet publishers and the users alike. To further facilitate filing and identification of documents and booklets, the bar, or its components can be made of colored materials. They also can be painted before or after fabrication or assembly. In addition, the body of the bar and its components can be of differnet colors, to further enhance their appeal to the user and to expand color-coding options for filing.

Accordingly, the reader will see that the suspension bar of this invention can be easily installed for suspension filing of booklets or documents, for their filing and retrieval. The damage to the booklets can be prevented, and the bar reused, by employing a low-tack adhesive attachment. Identification capabilities are effectively provided to thin brochures and single sheet documents, which thus can be easily located and identified in the filing system.

Although descriptions provided above contain many specific details, they should not be construed as limiting the scope of the present invention. For example, many retainers and detents can be interchanged and combined, and the bar components can be made from various materials and combinations thereof.

Thus, the scope of this invention should be determined from the appended claims and their legal equivalents, rather than by the descriptions given above.

I claim:

1. In a rail-based suspension filing system, a booklet suspension device comprising an essentially flat elongated body member, said body member comprising:

(a) front surface, (b) back surface, said front surface essentially parallel to said back surface, said body member further having suspension members on opposite ends, said suspension members interfaceable with supporting rails, said suspension members pivotable around axes perpendicular to said front surface of said body member between (1) a first deployed position, and (2) a second stowed position, said suspension members having essentially hooked end sections.

2. The device in claim 1, wherein said device further includes detent means to releasably secure said suspension members in the deployed and stowed positions, said body member further including support means to brace said suspension members in the deployed position.

3. The device of claim 1, wherein said body member further comprises attachment means for securing said device in the booklet, said attachment means utilized primarily for holding device inside the booklet when the booklet is out of filing system.

4. The device of claim 3, wherein the attachment means is an adhesive layer, said adhesive layer applied to at least one side of said device, said adhesive layer extending essentially through the length of the device, except for the suspension members, said adhesive layer further removably covered by protective means.

5. The device of claim 3, wherein the attachment means is an attachment lab, said attachment tab capable of being mounted inside the booklet.

6. In a rail-based suspension filing system, a booklet suspension device comprising an essentially flat elongated body member, said body member comprising:

(a) front surface (b) back surface, said front surface essentially parallel to said back surface, said body member further having suspension members on opposite ends, said suspension members interfaceable with supporting rails, said suspension members retractable with respect to said body member between (1) a first deployed position, and (2) a second stowed position, said suspension members having essentially hooked end sections wherein said body member comprises essentially an open channel, said open channel further comprising a rear member, an upper member and a lower member, said upper member and said lower member further containing longitudinal grooves to retain said suspension members within said open channel, said suspension members slide inside said open channel, said open channel providing support for said suspension members in the deployed position, said device further comprising detent means to releasably secure said suspension members in the deployed and the stowed positions.

7. The device of claim 6, wherein the attachment means is an attachement tab, said attachment tab capable of being mounted inside the booklet.

8. In a rail-based suspension filing system, a booklet suspension device comprising an essentially falt elongated body member, said body member comprising:

(a) front surface, (b) back surface, said front surface essentially parallel to said back surface, said body member further having suspension members on opposite ends, said suspension members interfaceable with supporting rails, said suspension members foldably hinged along axes parallel to said front surface of said body member and perpendicular to the longest dimension of said body member, said suspension members capable of being folded and unfolded with respect to said body member between (1) a first deployed position, and (2) a second stowed position, said body member having hinge sites essentially adjacent to the suspension members, said hinge sites located essentially inside the booklet, said suspension members having essentially hooked end sections.

9. The device in claim 8, wherein said device further includes retaining means to releasably secure said suspension members in the stowed position with respect to said body member.

10. The device claim 8, wherein said body member further comprises attachment means for securing said device in the booklet, said attachment means utilized primarily for holding device inside the booklet when the booklet is out of filing system.

11. The device of claim 10, wherein the attachment means is an adhesive layer, said adhesive layer applied to at least one side of said device, said adhesive layer extending essentially through the length of the device, except for the suspension members, said adhesive layer further removably covered by protective means.

12. The device of claim 10, wherein the attachment means is an attachment tab, said attachment tab capable of being mounted inside the booklet.

13. The device in claim 8, wherein said body member comprising two longitudinal members, said longitudinal members lengthwise foldably attached to each other, whereby at least one said longitudinal member contains said suspension members.

14. The device of claim 13, wherein said longitudinal members are capable of assuming upon deployment an essentially inverted V-shape with respect to each other, thereby enhancing weight bearing capability of the device.

* * * * *